US005559578A

United States Patent [19]

Umeda et al.

[11] Patent Number: 5,559,578

[45] Date of Patent: Sep. 24, 1996

[54] ELECTROSTATIC RECORDING APPARATUS WITH ELECTRIFIED CAP AND MANAGING SYSTEM THEREOF

[75] Inventors: Takao Umeda, Mito; Toru Miyasaka, Hitachi; Osamu Namikawa, Katsuta; Isamu Komatsu, Takahagi; Tetsuya Nagata; Yasuo Takuma, both of Hitachi; Tatsuo Igawa, Kitaibaraki, all of Japan

[73] Assignees: Hitachi, Ltd.; Hitachi Koki Co., Ltd., both of Tokyo, Japan

[21] Appl. No.: 175,867

[22] Filed: Dec. 30, 1993

Related U.S. Application Data

[63] Continuation-in-part of Ser. No. 917,709, Jul. 16, 1992, Pat. No. 5,373,351, and Ser. No. 827,939, Jan. 29, 1992, Pat. No. 5,404,201, which is a division of Ser. No. 325,386, Mar. 20, 1989, Pat. No. 5,138,380.

[30] Foreign Application Priority Data

| | | | |
|---|---|---|---|
| Mar. 22, 1988 | [JP] | Japan | 63-65636 |
| Dec. 6, 1988 | [JP] | Japan | 63-306844 |
| Jul. 22, 1991 | [JP] | Japan | 3-204539 |

[51] Int. Cl.[6] ..... G03G 15/00; G03G 21/00

[52] U.S. Cl. ..... 355/208; 355/209; 355/213

[58] Field of Search ..... 355/213, 208, 355/216, 219, 221–225, 203, 204, 206, 209; 364/930.7, 930.3, 919.1, 920.7

[56] References Cited

U.S. PATENT DOCUMENTS

| | | | |
|---|---|---|---|
| 4,076,410 | 2/1978 | Kono et al. . | |
| 4,097,138 | 6/1978 | Kingsley . | |
| 4,167,322 | 9/1979 | Yano et al. . | |
| 4,219,272 | 8/1980 | Bruckel et al. . | |
| 4,583,834 | 4/1986 | Seko et al. | 355/206 |
| 5,101,234 | 3/1992 | Suzuki et al. | 355/213 |
| 5,128,719 | 7/1992 | Umeda et al. | 355/213 |

FOREIGN PATENT DOCUMENTS

| | | |
|---|---|---|
| 49-40737 | 4/1974 | Japan . |
| 57-19775 | 2/1982 | Japan . |
| 58-9185 | 1/1983 | Japan . |
| 59-136771 | 8/1984 | Japan . |
| 2-139583 | 5/1990 | Japan . |
| 2-12571 | 1/1996 | Japan . |

OTHER PUBLICATIONS

"Copier Adjustment", B. A. Nisson, IBM Technical Disclosure Bulletin, vol. 22, No. 8B, Jan./1980, pp. 3606–3608.

"Remote Photoreceptor Replenishment", D. Levy, Xerox Disclosure Journal, vol. 3, No. 1, Jan./Feb. 1978, pp. 77–78.

*Primary Examiner*—Arthur T. Grimley
*Assistant Examiner*—Shuk Y. Lee
*Attorney, Agent, or Firm*—Antonelli, Terry, Stout & Kraus

[57] ABSTRACT

An electrostatic recording apparatus and a management system thereof wherein the recording apparatus includes a photoconductor drum having a cap provided at an opening of the drum and a photoconductor sheet wound on a portion of the drum other than the opening, with the photoconductor drum being rotated. The cap is electrified and a capacitor is provided between the cap and a terminal and charged through the cap to maintain the cap in an electrified state. A potential of the terminal is equal to a ground potential or a potential approximating the ground potential. Further, a controller is provided for discharging the electrified electric charge of the cap in response to a discharge instruction. A managing system may be provided for judging the state of the electrostatic recording apparatus.

26 Claims, 21 Drawing Sheets

FIG. 3E
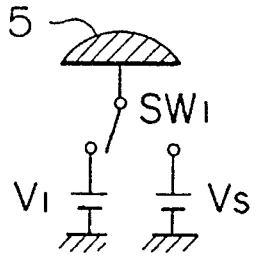
FIG. 3F
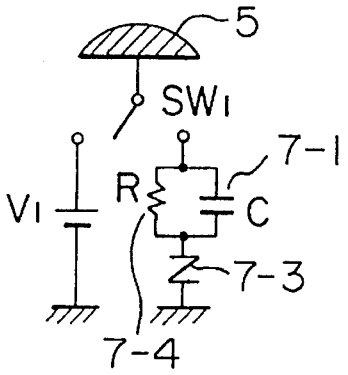
FIG. 3G
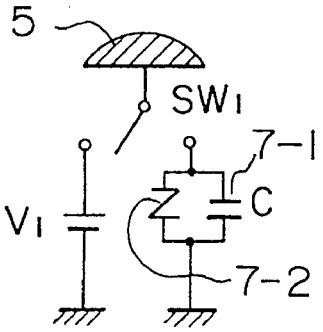
FIG. 3H(a)
FIG. 3H(b)
FIG. 3H(c)
FIG. 3H(d)
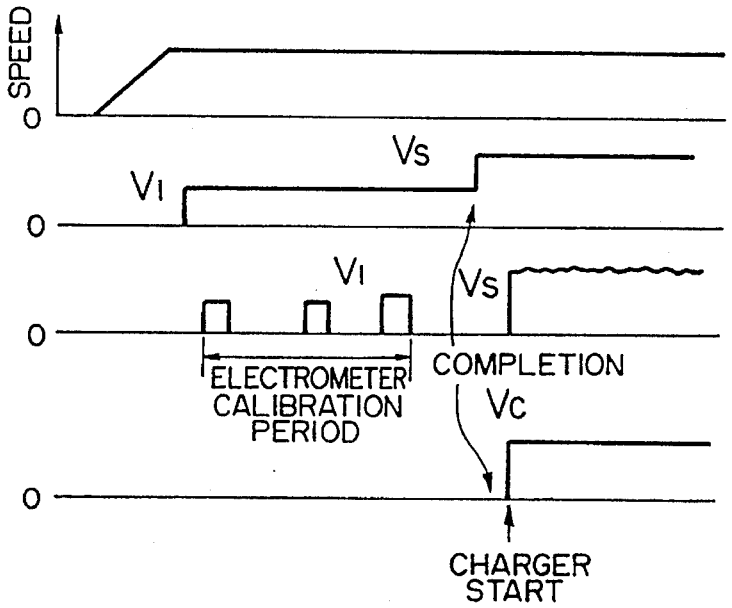

ELECTROSTATIC RECORDING APPARATUS WITH ELECTRIFIED CAP AND MANAGING SYSTEM THEREOF

CROSS REFERENCE TO THE RELATED APPLICATIONS

This patent application is a continuation-in-part application of the U.S. patent application Ser. No. 07/917,709, filed Jul. 16, 1992, now U.S. Pat. No. 5,373,351 and the U.S. patent application Ser. No. 07/827,939, filed Jan. 29, 1992, now U.S. Pat. No. 5,404,201 which is a divisional continuation application of the U.S. patent application Ser. No. 07/325,386 filed Mar. 20, 1989 which has been patented as U.S. Pat. No. 5,138,380. The disclosure of these applications is incorporated herein by reference.

BACKGROUND OF THE INVENTION

1. Field of the Invention

The present invention relates to an electrostatic recording apparatus of electrophotographic type, and more particularly to an electrostatic recording apparatus using a photoconductor drum having photoconductor sheet wound on a drum surface and a managing system therefor.

2. Description of the Related Art

In an electrostatic recording apparatus, in general, a photoconductor sheet is charged with electricity through an exposure of an optical image to produce an electrostatic latent image, which is then developed to obtain a toner image on the photoconductor sheet. Thereafter, the toner image is transferred onto a sheet of paper to be fixed on the sheet, thereby achieving a recording operation. In this process, the amount of electricity charged on the photoconductor sheet, namely, the level of an electric potential of the photoconductor sheet determines the effect of the electrostatic recording process, and hence there is disposed a control mechanism associated therewith.

There has been filed a Japanese patent application (JP-B-61-56514 corresponding to JP-A-54-37760) in which a portion of a photoconductor sheet is wound on a drum such that a utilized portion of the photoconductor sheet is changed by winding up the sheet. In such a photoconductor sheet of the winding type, a cap portion of an opening disposed on the drum to pass the photoconductor sheet in the forward and backward directions is set to a ground potential in any situation or the cap potential is set to the ground potential when the cap portion is located at a position opposing to surface potential detector. An object of this system is that a zero potential correction is conducted on the surface potential detector when the cap portion passes under the surface potential detector. Another object thereof is to measure the surface potential of the photoconductor sheet by the surface potential detector so as to control a charging device or charger. In either case, the potential of the cap portion is open or is set to the ground potential.

On the other hand, the JP-A-58-4172 describes a system in which when the cap portion is set to a location opposing to the surface potential detector, a calibration voltage is connected to the cap portion so that the surface potential detector is calibrated, or the cap portion is connected to an ammeter to measure a corona current so as to adjust an output from the power source for the charging device.

According to the technique described above, the cap portion (reference potential measured section) disposed in a portion of the surface of the photoconductor sheet is employed as an electrode to calibrate the surface potential detector or as an electrode to detect the corona current of the charging device.

A conventional technique concerning an electrostatic recording apparatus using a photoconductor drum having a photoconductor sheet wound on the surface is disclosed in JP-A-49-40737. This conventional technique concerns an electrostatic recording apparatus using a photoconductor sheet wound drum, in which a photoconductor sheet is drawn out from a stock roll accommodated in the drum, to the outside of the drum via an opening formed in part of the drum, to be wound on the surface of the drum and is then taken in the drum through the opening again to be wound by a take-up roll. A metal portion of a drum cap of a normal development type copying machine is connected to a ground potential and has a surface on which high resistive film such as aluminum oxidized film is formed so that toner is not attached on the surface of the drum cap.

Further, a technique concerning the electrostatic recording apparatus of this type is disclosed in JP-A-2-139583, proposed by inventors including one of the inventors of the present invention. In this technique, a drum cap is utilized to measure a surface potential of a photoconductor on a photoconductor drum.

SUMMARY OF THE INVENTION

The present invention is devised to further effectively utilize the cap portion and has the following objects.

An object of the present invention is to provide a surface potential controller in which a surface potential of a reference potential section and a surface potential of a charge receiving surface of the photoconductor are measured and compared with each other so that the charging device can be controlled to equalize the potentials in the charge receiving surface and the cap portion to each other, thereby achieving a high reliability without necessarily requiring a calibration of the surface potential detector.

Another object of the present invention is that when the reference potential section passes under a developer, the reference potential measured section is charged with electricity depending on a develop condition (normal or reverse development for a positive or negative image) so that toner is prevented from attaching onto the reference potential measured section.

In addition, still another object of the present invention is that the surface potential or current is measured on the photoconductor sheet after the charging operation or after the exposure to be used to evaluate a life of the photoconductor sheet, thereby providing a method of determining the time when the utilized portion of the photoconductor sheet is to be replaced.

It is an object of the present invention to provide an electrostatic recording apparatus including a photoconductor drum having a photoconductor sheet wound on a drum surface and capable of preventing toner from being attached on a cap surface or electric shock from occurring and of effecting recording with high image quality, as well as effective utilization of a drum cap in management and diagnosis of a state of the electrostatic recording apparatus.

Furthermore, another object of the present invention is to provide a managing system combined with an information processing apparatus such as a computer and a personal computer in which an electrostatic recording apparatus is not limited only to a receiver of print data and also supplies data indicating a state of the photoconductor sheet and or data to be used to evaluate the picture quality to the information processing apparatus which processes the data thus received and feeds back the processed result or an instruction to the electrostatic recording apparatus in an interactive manner.

Next, a brief description will be given of the summary of the basic principle of the present invention devised in order to achieve the objects above mentioned.

There is disposed an area free from transferring operation on the surface of a drum including a photoconductor sheet as a reference potential measured section and there is disposed a unit to supply the area with a voltage directly or indirectly from an external power supply to set the portion to a predetermined potential. The method to indirectly supply the voltage means a method to supply electric charge by a charging device. In this fashion, the surface potential detector can measure during the rotation of the photoconductor drum the potential of a cap as the reference potential measured section and that of the charge receiving surface of the photoconductor sheet at a predetermined interval or cycle, to determine difference between the potentials. A charging device is adjusted to minimize the difference in potential to vary the potential of the charge receiving surface. The detection error of the surface potential detector can be regarded as constant during a rotation of the drum. Therefore, a highly precise surface potential control can be accomplished without frequently achieving the calibration of the surface potential detector. In addition, when the potential of the reference potential measured section is appropriately set depending on the development condition, it is possible to prevent the toner from attaching onto the portion when the portion passes under the developer. Furthermore, it is possible to recognize a great change or an irregular change in the potential due to deterioration of the charge receiving surface, which enables the deterioration of the charge receiving surface of the photoconductor sheet to be detected to evaluate the life of the photoconductor sheet.

In the electrostatic recording apparatus of reversal development type using the photosensitive or photoconductor drum on which the photoconductor sheet is wound, when the surface potential of the cap provided to the photoconductor drum is lower than a developing bias voltage, toner can be prevented from being attached on the surface of the cap. Further, as methods of realizing this measure, there are proposed a method of retracting the developer mechanically and a method of electrically controlling the developing bias voltage, and these methods can be selected in accordance with a machine specification.

A DC voltage of −700 to −900 volts is applied to a capacitor connected to the cap during operation of the electrostatic recording apparatus. The substantially same voltage is applied thereto heretofore when the electrostatic recording apparatus is stopped in repairing of a jam of paper or exchanging of the drum. In the present invention, however, since electric charge of the capacitor can be removed immediately when the apparatus is stopped, electric shock does not occur even if an operator comes into contact with the cap. By employing a sequence in which an openable signal of a door is issued after removal of electric charge, improvement of safety can be further attained.

Although electric charge of the capacitor connected to the cap is removed when the photoconductor drum is stopped, since the cap portion is stopped to be opposite to the charger, the capacitor can be rapidly charged by the charger when the photoconductor drum is started again after recovery of a failure and the surface potential of the cap can be made substantially equal to the surface potential of the photoconductor of an unexposed portion rapidly. Accordingly, a restarting or restoring time can be made short. In this connection, several seconds to several tens of seconds are required for the restarting time in conventional devices heretofore, while the restarting time can be reduced within one second in the present invention.

Since the surface potential of the cap is monitored by a surface potential measuring portion, the series of countermeasures described above can be implemented certainly in accordance with the measured value.

In the electrostatic recording apparatus using the photoconductor sheet wound type photoconductor drum and the belt transfer type, a transfer belt can be prevented from being pressed on a step between the cap and the drum. Generally, the belt is pulled by a fixed tension. Accordingly, when the belt is flawed the transfer operation fails and the belt is cracked and cut. On the other hand, in the present invention, since there is no disadvantage that the belt is flawed, the problem can be solved.

Since a gap between a developer roll and the photoconductor, that is, a developing gap can be made uniform, the noncontact development characteristic necessary for the high-speed color development can be improved.

Since a current flowing in the transfer belt or a developing agent layer can be measured using the cap of the drum as a current detecting electrode, the life of the transfer belt and the developing agent and an amount of paper power contained in the developing agent can be estimated.

Since information such as a current flowing from the transfer belt for estimating the life of the transfer belt and a current flowing from the developing roll for estimating the amount of paper powder in the developing agent can be collected from a plurality of electrostatic recording apparatuses to a central information processing apparatus through a communication line, exact judgment and optimum countermeasure for situation can be implemented for each of the electrostatic recording apparatuses by performing analysis of the information, statistical processing and comparison with respective past data for each of the apparatuses.

BRIEF DESCRIPTION OF THE DRAWINGS

These and other objects and advantages of the present invention will become apparent by reference to the following description and accompanying drawings wherein:

FIGS. 3E, 3F, and 3G are diagrams showing examples of configuration in which the cap is charged with two types of power supply;

FIGS. 3H(*a*), 3H(*b*), 3H(*c*) and 3H(*d*) are diagrams showing an operation of calibration of an electrometer and charging of the cap;

DESCRIPTION OF THE PREFERRED EMBODIMENTS

The present invention will be explained in detail with reference to the accompanying drawings.

Figure 1A:
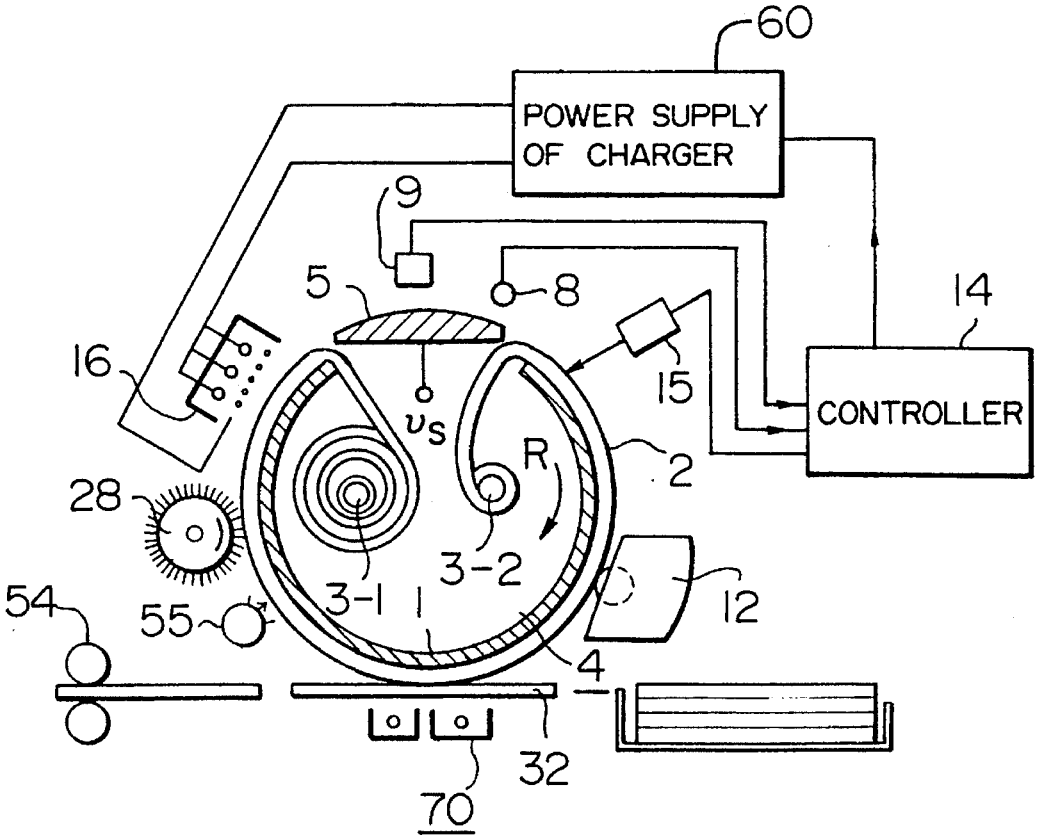
FIGS. 1A and 1B are schematic diagrams showing an embodiment of the present invention.
Figure 1B:
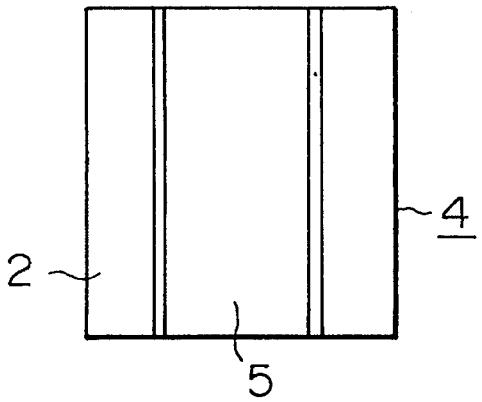

FIGS. 1A and 1B show an embodiment according to the present invention. In the configuration of FIG. 1A, a portion of the photoconductor sheet 2 is drawn from a stock roll 3-1 to the outside through an opening disposed in a portion of the drum 1 to be wound on the drum 1; thereafter, the sheet 2 is again fed through the opening to the inside to be wound on a take-up roll 3-2, thereby constituting the photoconductor drum 4. The opening is covered by a cap 5 insulated with respect to the drum 1. This cap 5 is employed as a reference potential measured section formed in an area of the surface of the photoconductor drum 4. The photoconductor drum 4 turns in the direction of the arc arrow R.

The photoconductor sheet 2, namely, the electric charge receiving surface is charged by a charger 16, and then an exposure unit 15 effects an exposure of an optical image to form a latent image thereon. Thereafter, the latent image is developed by a developer 12 to be a toner image as a visible image, which is then transferred onto a sheet of paper 32 by a transfer unit 70. The transferred toner image is fixed onto the sheet of paper 32 by a fixer 54 and the sheet of paper 32 is ejected from the apparatus. On the other hand, the residual potential of the photoconductor drum 4 is removed by an eraser 55 and then the remaining toner is cleaned up from the surface of the photoconductor sheet by a cleaner 28. Thereafter, the process steps are repeatedly accomplished beginning from the charging step.

In FIG. 1A, reference numerals 8, 60, and 14 indicate a detector to detect a position of the cap 5, a power supply of the charger 16, and a controller, respectively.

Figure 2:
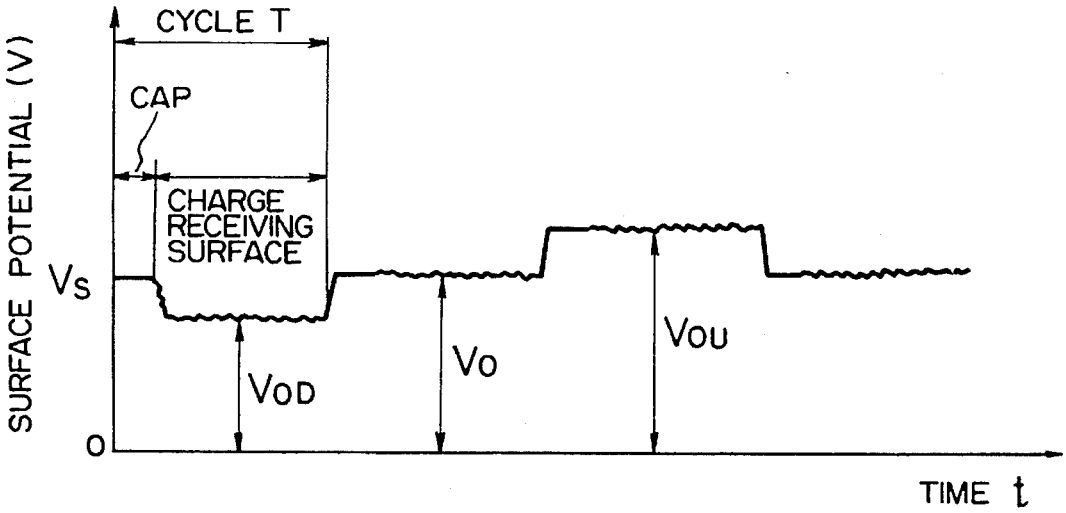
FIG. 2 is a diagram for explaining a basic operation principle according to the present invention in which there is shown a variation with respect to time of the surface potential of a photoconductor sheet.

Next, description will be given of an operation in a case where a reference potential measured section is provided. FIG. 1B is a plan view of the photoconductor drum 4 when the cap 5 disposed as the reference potential measured section is positioned on the top. FIG. 2 shows the variation with respect to time, of a potential measured on the surface of the photoconductor drum 4 by the surface potential detector 9 disposed above the photoconductor drum 4. FIG. 2 shows a characteristic when the surface of the photoconductor is charged by the charger 16. The potential $V_S$ of the cap 5 can be arbitrarily set by an external power supply. The voltage of the external power supply is determined based on a material of the charge receiving section (photoconductor) such that the cap 5 is set to a potential $V_S$. The surface potential of the charge receiving section varies depending on charging conditions of the charger (the charge voltage, the grid voltage, etc.) and the degree of wear of the charge receiving section surface. If the charging conditions are not appropriate, the surface potential $V_O$ of the charge receiving surface becomes lower or higher than the potential $V_S$. In consequence, the value of $V_O$ needs to be controlled so as to take a value in the proximity of $V_S$.

In this constitution, the reference potential measured section including the cap 5 is disposed on a surface of the photoconductor drum 4. By controlling the charger during the rotation of the drum 4, the surface potential detector 9 outputs substantially the same potential of the photoconductor drum surface as that of the reference potential measured section. Thus, the surface potential of the photoconductor sheet can be controlled to be appropriate. As shown in FIG. 2, through a comparison of the surface potential of photoconductor drum 4 with that of the reference potential measured section, relation of the voltage and the charger is determined so that correction is made in the subsequent cycles.

According to this configuration, the surface potential detector 9 needs not to measure the absolute surface potential of the photoconductor drum 4, that is, without achieving an absolute calibration of the surface potential detector 9, the surface potential of the photoconductor drum 4 can be controlled with a high precision.

In the configuration of FIGS. 1A and 1B, there is employed the position detector 8 to determine the position of the cap. In consequence, it may also be considered that the cap needs not to be limited to a reference value, namely, a detecting operation may be effected by the position detector based on a portion of the photoconductor sheet 2 to measure the surface potential, which is then used as a reference value for a comparison with a potential of another section.

The photoconductor sheet 2 is gradually deteriorated during a long-term use. The deterioration includes electric, mechanical, and chemical deterioration. When the photoconductor sheet 2 is exposed to corona discharge, the surface of the photoconductor sheet 2 is oxidized with a lapse of time, resulting in decrease of the surface resistance. Also, when defects such as a pinhole existing in the photoconductor sheet 2 are exposed to the corona discharge, the volume resistivity decreases locally. These phenomena cause the electric deterioration. As a chemical deterioration, there can be considered a deterioration caused, for example, by ozone and $NO_3$. In addition, the mechanical deterioration is caused by the cleaner 28 because of a developing material (primarily, a carrier) attached onto the surface of the photoconductor drum 4 in the development. In actuality, there appears a composite deterioration associated with a combination of these phenomena.

When the photoconductor sheet 2 undergoes a deterioration, the smoothness of the surface thereof is lost so that the surface potential distribution is not uniform after the charging operation, namely, there randomly appear locations where the surface potential is locally high or low. Such an adverse state cannot be coped with only by voltage control of the charger and it is necessary to replace the photoconductor sheet. For the reason, there is provided a controller such that the potential distribution on the charge receiving surface is measured by the surface potential detector 9 to be compared with a reference value, thereby achieving the life evaluation of the photoconductor sheet 2.

In addition, during the drum 4 rotation, potentials are measured on the reference potential measured section and the charge receiving surface by the surface potential detector 9 to obtain the difference between the measured potentials such that the charger is adjusted to change the potential of the charge receiving surface, resulting in minimizing the difference in potential. In this case, a detection error of the surface potential detector can be regarded as a constant during the rotation of the drum. In consequence, without frequently effecting the calibration of the surface potential detector 9, the surface potential can be controlled with a high precision. Furthermore, if the potential of the reference potential measured section is appropriately set depending on the development conditions, it is possible to prevent toner from attaching onto the portion which passes under the developer 12. In addition, the surface potential detector 9 measures the potentials on the reference potential measured section and on the charge receiving surface and based on the difference between the measured potential values and the potential distribution a greater change and an irregular change in the potential are detected so that the deterioration of the charge receiving surface, i.e., the photoconductor sheet 2 is found.

Next, referring to FIGS. 3A to 3K, description will be given of a modification of the embodiment according to the present invention.

Figure 3A:
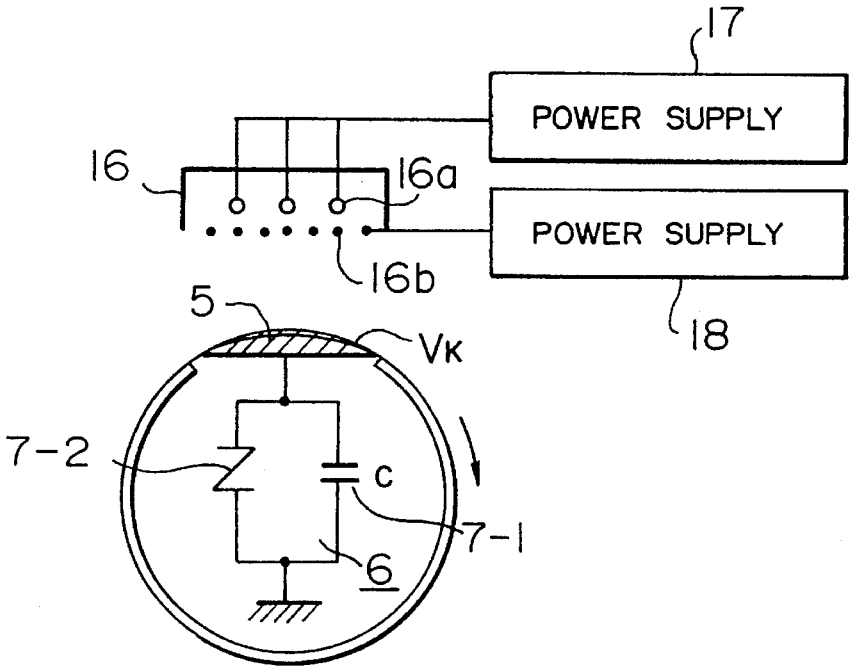
FIG. 3A is a diagram showing an example of configuration by which a cap is kept retained at a reference potential.

In FIG. 3A, the cap 5 as the reference potential measured section is kept retained at a reference potential. There is disposed a charger 16 for supplying the reference potential to the cap 5 without using an additional direct-current power supply in this embodiment. The cap 5 is connected to a parallel circuit 6 of a varistor 7-2 as a voltage regulating element and a capacitor C, which are connected to the ground potential. There are also disposed power supplies 17 and 18 for the charger 16.

Figure 3B:
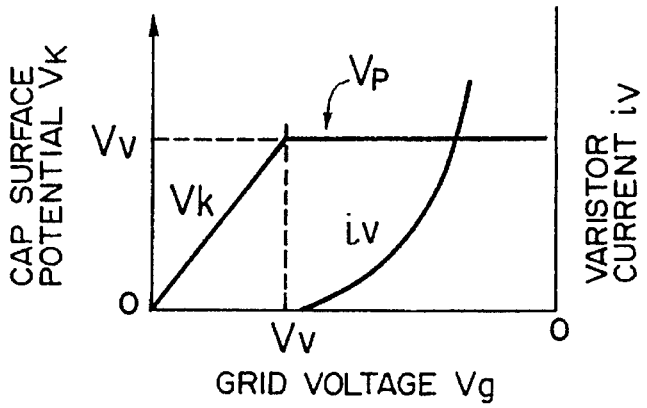
FIGS. 3B and 3C are diagrams showing variation of the cap potential.

Of the scorotron charger 16 disposed to oppose to and to be separated from the cap 5, a voltage $V_c$ of a discharge wire 16*a* or a voltage $V_g$ of a grid 16*b* is increased. At this time a surface potential $V_k$ of the cap 5 is changed as shown in FIG. 3B. In this figure, $V_V$ stands for an operation potential (a varistor voltage) of the varistor 7-2 and $i_V$ is a varistor current. As can be seen from FIG. 3B, the surface potential $V_k$ of the cap 5 increases as the grid voltage $V_g$ increases and when the potential $V_k$ reaches the operation potential $V_V$ of the varistor 7-2, the potential $V_k$ is saturated and then the varistor current $i_v$ starts increasing. In this fashion, the surface potential of the cap 5 as the reference potential measured section is kept retained at the potential $V_V$.

Figure 3C:
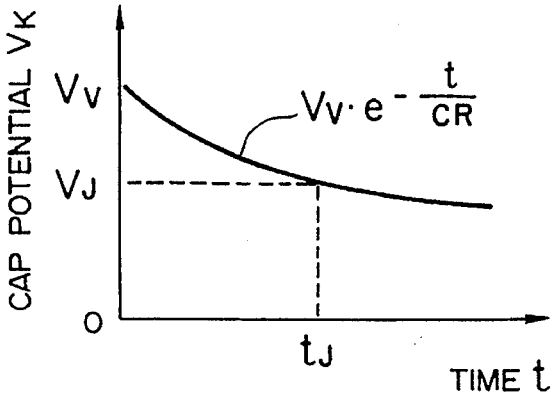

FIG. 3C is a graph showing a variation, with respect to time, if the cap surface potential $V_k$ after the cap 5 has passed under the charger 16. As shown here, the potential $V_k$ decreases in association with a time constant of C and R, where R is a resistance of the varistor 20. In a case where the developing method is of a normal development, if the potential of the cap 5 is set to a value lower than a development bias potential when the cap 5 passes under the developer 12 of FIG. 1A, toner does not attach thereonto. Also in a case where a reference potential measured section other than the cap is disposed, it is only necessary to set the potential of the reference potential measured section to be lower than the bias potential. In a case of a reverse development, the potential of the reference potential measured section needs only to be set to be higher than the bias potential to prevent the toner from attaching thereonto. The potential $V_j$ at a point of time when the cap 5 passes under the surface potential detector 9 (FIG. 1A) is expressed as follows.

$$V_J = V_V \cdot e^{-\frac{t}{C \cdot R}}$$

In order to set the potential of the charge receiving surface of the photoconductor sheet 2 to the reference potential $V_S$, it is only necessary to select a varistor having an operation voltage $V_V$ as follows.

$$V_V = V_S \cdot e^{\frac{t}{CR}}$$

As a result, when the cap 5 passes under the surface potential detector 9, the potential $V_k$ of the cap 5 is lower than $V_S$. As described above, by using the varistor, C, and R, the usage of another external power supply is unnecessitated. In order to directly supply power from an external power source, there is required a slip ring mechanism. However, it is also unnecessary in the system according to the present invention. In this manner, according to the present invention, there is implemented a simple method and there is not required any additional power supply. Hence, a compact system can be configured at a low cost.

Figure 3D:
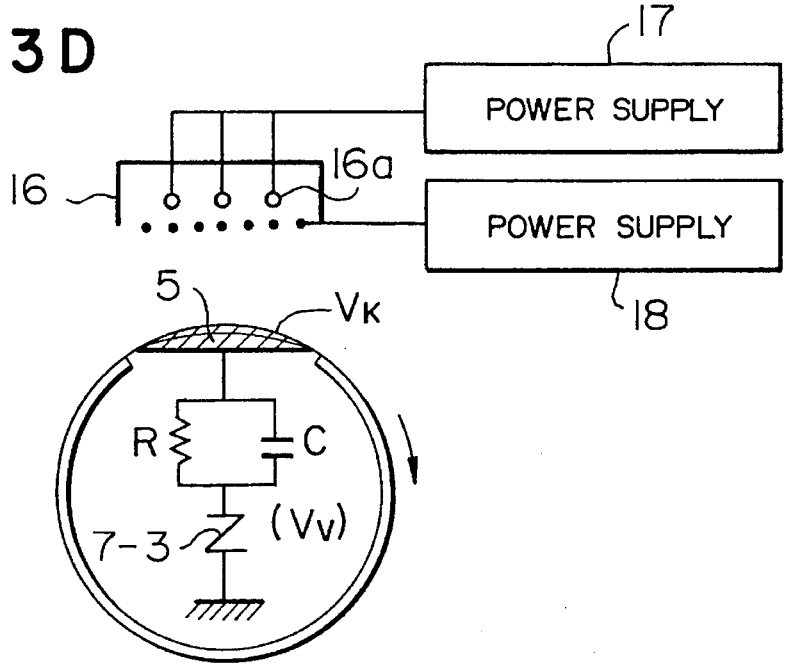
FIG. 3D is a diagram showing another example of configuration by which a cap is kept retained at a reference potential.

As shown in FIG. 3D, in addition to a parallel connection of a capacitor C and a resistor R, the varistor 20 is further connected in series so as to link the cap 5 to the ground potential, which also leads to the similar operation and effect. Further, by using a Zener diode in place of the varistor 20, the similar operation and effect can be developed. In short, it is possible to select an appropriate one of voltage regulating elements.

FIGS. 3E, 3F, and 3G show other modifications in which there is employed an additional power source to give a potential to the cap 5. As shown in FIG. 3E, the cap 5 is applied with two kinds of voltages depending on a change-over operation of a switch $SW_1$, where $V_1$ is a calibration voltage and $V_S$ stands for a voltage on the charge receiving surface. FIGS. 3H(*a*) to 3H(*d*) show an example of operation timing charts in a case where after the surface electrometer or surface potential detector 9 is calibrated, the surface of the photoconductor sheet 2 is uniformly charged up with electricity. That is, after the drum rotation speed is set to a constant value as shown in FIG. 3H(*a*), the cap 5 is first connected to the power source voltage $V_1$ to set the cap potential to the calibration voltage $V_1$, as shown in FIG. 3H(*b*). In this state, as shown in FIG. 3H(*c*), the surface electrometer 9 measures the cap potential to be calibrated such that the surface electrometer 9 indicates the voltage value $V_1$. When the calibration is finished, the switch is changed over so as to set the cap potential to $V_S$, as shown in FIG. 3H(*b*). Subsequently, the operation of the charger 16 is started, as shown in FIG. 3H(*d*). The charger 16 is controlled to keep the indication $V_S$ in the electrometer 9. Thus, the electrometer 9 can be correctly calibrated. In this case, although two additional external power sources are required, as shown in FIGS. 3F and 3G, the configuration on the $V_S$ side may be the same as that of FIGS. 3D and 3A, respectively. In this situation, the number of additional power sources can be reduced to one.

Figure 3I:
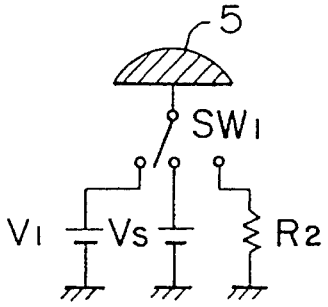
FIGS. 3I and 3J are diagrams showing other examples of configuration in which the cap is charged with two types of power supply.
Figure 3J:
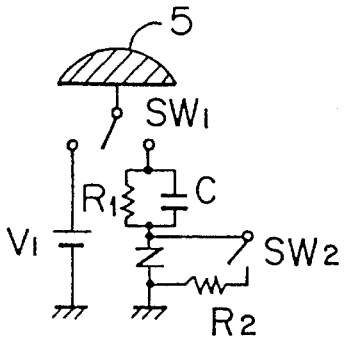
Figure 3K:
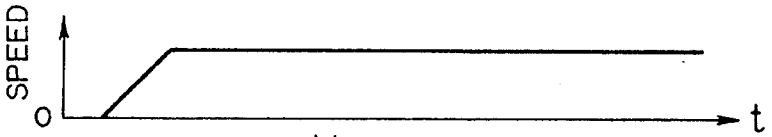
FIGS. 3K(*a*), 3K(*b*), and 3K(*c*) are diagrams showing an operation of calibration of an electrometer and charging of the cap.
Figure 3K:
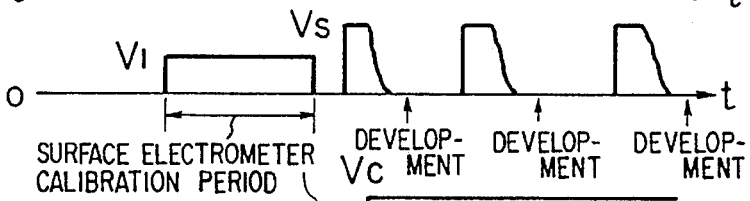
Figure 3K:
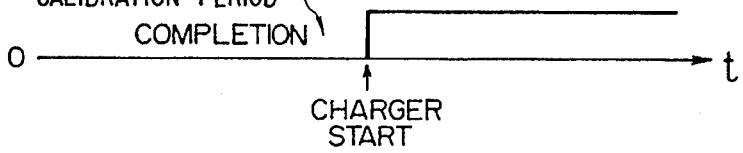

Description has been given of a case of the reverse development with reference to FIGS. 3A to 3K. In this configuration, it is necessary that the potential of the cap 5 is kept at a value sufficiently higher than the development bias potential when the cap 5 passes under the developer 12 to prevent the toner from attaching onto the cap 5. In contrast, in a case of the normal development, it is necessary that the potential of the cap 5 is kept at a value sufficiently lower than the development bias potential when the cap 5 passes under the developer 12. FIGS. 3I and 3J show power supply systems to be connected to the cap 5 in the case of the normal development. FIG. 3I is associated with a case where the cap potential is .entirely given from additional power supplies, where $V_1$ is a calibration voltage, $V_S$ is given as a reference potential to be used to control the surface potential of the charge receiving surface, and $R_2$ indicates a current limiting resistor in decreasing the cap potential to the ground potential. FIGS. 3K(*a*) to 3K(*c*) shows operation timing charts in which after the drum 4 starts rotating as shown in FIG. 3K(*a*), the potential of the cap 5 is first set to $V_1$ as shown in FIG. 3K(*b*) to be measured by the surface potential electrometer 9, thereby calibrating the surface potential electrometer 9. After the calibration is completed, the potential of the cap 5 is set to $V_S$ and then, as shown in FIG. 3K(*b*), the charger 16 is initiated so that the potential of the charge receiving surface after the charging operation is detected by the surface electrometer 9 to be used to control the charger 16 such that the surface potential is a detected value $V_S$. That is, the charger voltage $V_C$, the grid voltage $V_G$, or the corona current undergoes a change. Thereafter, the cap 5 is grounded through a resistance $R_2$ so that the cap potential is lower than the bias potential of the developer 12 and then the cap 5 is passed below the developer 12. Subsequently, this operation is repeatedly effected.

In FIG. 3J, in place of the power supply $V_S$ of FIG. 3I, there are employed a resistor $R_1$, a capacitor C, a varistor and a switch $SW_2$, which enables an external additional power supply to be removed.

Figure 4A:
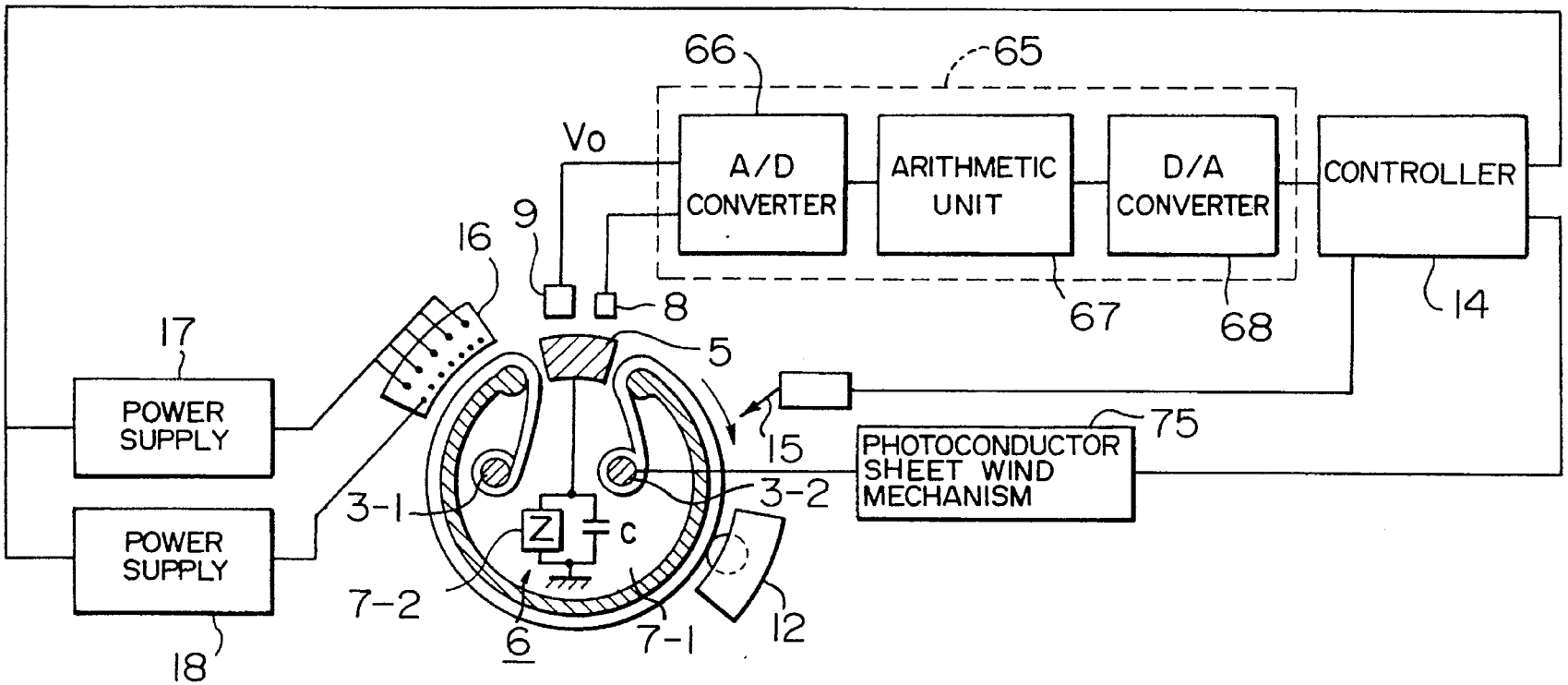
FIGS. 4A and 4B are diagrams showing a configuration of an electrostatic recording apparatus including a photoconductor sheet replace system based on a surface potential control and a life evaluation of the photoconductor sheet surface.
Figure 4B:
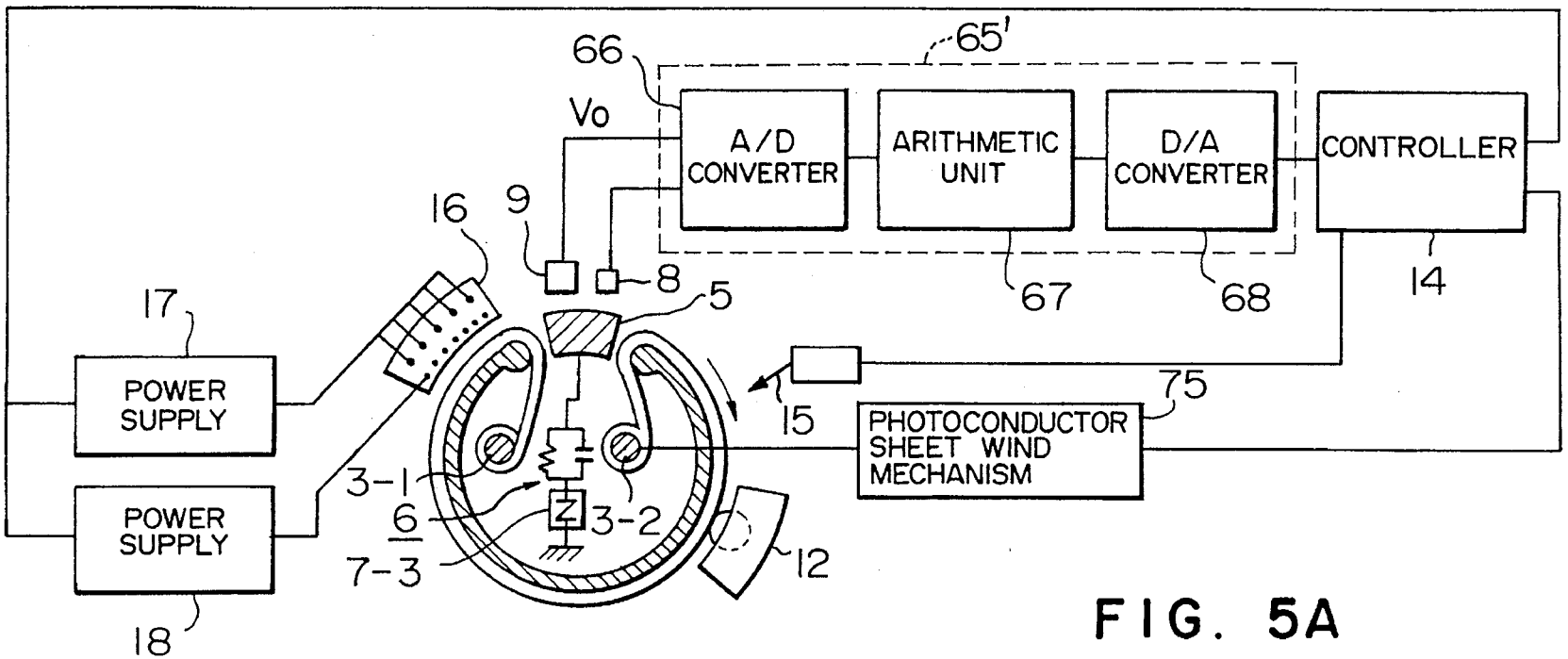

FIGS. 4A and 4B show photoconductor sheet replacing systems to which the surface potential control and life evaluation of the photoconductor sheet according to the present invention are applied. FIG. 4A shows an electrostatic recording apparatus in which a varistor circuit corresponding to FIG. 3A is disposed, whereas FIG. 4B shows an electrostatic recording apparatus in which a varistor circuit corresponding to FIG. 3D is disposed. As described with reference to FIGS. 3A to 3K(*c*), the reference potential $V_S$ of the charge receiving surface of the photoconductor sheet is applied from the charger 16 to the cap 5.

The operation is effected as follows.

(i) The position detector 8 detects a position of the cap 5 as the reference potential measured section, and the value (which is not necessarily an absolute value) measured at this point of time by the surface potential detector 9 is inputted as the reference voltage $V_S$ of the charge receiving surface to an arithmetic processing section 65 which is omitted in FIG. 1A. In the operation to measure the cap surface potential, in order to avoid an effect, for example, of a gap between the cap 5 and the photoconductor sheet 2, there may be employed a method in which the measured value obtained at the center of the cap is supplied as the reference potential to the arithmetic processing section 65, which includes an analog-to-digital (A/D) converter 66, an arithmetic unit 67, and a digital-to-analog (D/A) converter 68. The arithmetic unit 67 includes a central processing unit (CPU), a random access memory (RAM), a read-only memory (ROM), and the like (they are not shown).

(ii) The surface potential detector 9 measures the surface potential $V_O$ of the charge receiving surface to supply the arithmetic processing section 65 with the potential $V_O$, which is then compared with the reference voltage $V_S$ of the charge receiving surface previously inputted in the step (i). Based on the comparison result, the controller 14 controls the charger power supplies 17 and 18 such that, as shown in FIG. 2, the charge receiving surface potential $V_O$ can be substantially identical to $V_S$ in the next cycle. As a method of controlling the charger power supplies 17 and 18, the control may be effected on the grid voltage $V_g$ of the grid 16*b*, the wire voltage $V_C$ of the discharge wire 16*a*, or the corona current Ic.

(iii) In a case where the charge receiving surface potential cannot reach the preset value (including $V_S$) due to the deterioration of the wound portion of the photoconductor sheet 2 even when the voltage and current of the charger 60 are increased, it is determined that life of the wound portion of the photoconductor sheet 2 has ended, so that a new portion of the photoconductor sheet 2 is drawn out through the photoconductor sheet wind mechanism 75 which is omitted in FIG. 1A. As the parameters to evaluate the life of the photoconductor sheet, there may also be employed, in addition to the charge receiving surface potential (absolute value) the varying value of the surface potential.

(iv) When the electrostatic recording apparatus is in the halt or inoperative state, the photoconductor drum 4 is in the stationary state. In this state, when a measurement electrode of the surface potential detector 9 is located to oppose the charge receiving surface of the photoconductor sheet 2, the residual potential (corresponding to 100 to 200 $V_{DC}$) influences the measurement electrode of the surface potential detector 9. For example, the measurement electrode is charged up. For this reason, when the photoconductor drum 4 is stationary, the surface potential detector 9 is disposed to oppose the cap 5 whose potential is zero.

As shown in FIG. 4A, in a case where there is disposed a constant-voltage circuit 6 including a capacitor 7-1 and a varistor 7-2 and in a case as shown in FIG. 4B where a fixed resistor is combined therewith to form a constant-voltage circuit 6, substantially zero potential can be obtained within several seconds after the photoconductor drum 4 is stopped, if the characteristic values of these electric parts are appropriately selected. As a result, there may be avoided the adverse influence to charge up the surface potential detector 9. In addition, the electric field is also substantially zero in the vicinity of the surface potential detector 9. Therefore, there can be solved the problem that the toner is dispersed to attach onto the measurement electrode of the detector 9 and to cause a failure thereof.

Furthermore, during the halt or stationary state of the drum 4, it is possible to achieve a zero-point correction for the surface potential detector 9.

Figure 5A:
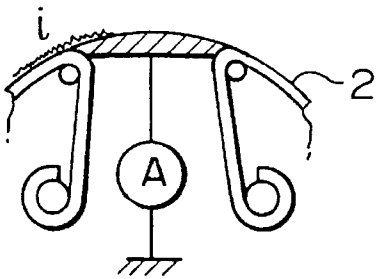
FIGS. 5A and 5B are diagrams showing another modification in which a life evaluation is conducted depending on the surface current control of the photoconductor sheet after the charging operation with respect to the surface potential control of FIGS. 4A and 4B.

FIG. 5A is an explanatory diagram useful to explain another method of evaluating the life of the photoconductor sheet. When the photoconductor sheet 2 undergoes a long-term operation, there appears wear as described above. In particular, when the surface is damaged to form a defect, the resistance of the damaged portion of the photoconductor sheet 2 is greatly decreased to 1/100 to 1/1000 of the initial value in a humid environment. As a result, there occurs a deformation of an image, which leads to a deterioration of the picture quality. Based on the aspect above, also by measuring the surface current of the photoconductor sheet after the charge operation, the life (the wear state) of the photoconductor sheet can be evaluated. In order to apply this method to a practical case, the cap 5 is formed of an electric conductor to be brought into contact with the surface of the photoconductor sheet. In this case, an end portion of the cap 5 is desirably constituted of a conductive rubber or the like not to damage the photoconductor sheet surfaces.

Figure 5B:
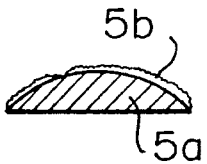

FIG. 5B shows a configuration example of the cap 5. In the foregoing description, although the material of the cap 5 has not been particularly described, the cap 5 may be formed of metal material such as aluminum in a case where the transfer method is associated with the corona transferer. However, in the case of a roller transfer operation, since rubber material is generally employed for the roller, if the metal cap portion is kept brought into contact with the roller, there exists a possibility that the rubber roller is worn. In this situation, it is desirable to dispose a soft cap. That is, the cap is favorably made of a conductive rubber or a conductive rubber film 5*b* is desirably formed on a metal material 5*a*. In addition, a conductive resin may be employed in place of the conductive rubber.

As shown in FIG. 5A, an ammeter is connected between the cap 5 and the ground potential to detect a leakage current from the photoconductor sheet surface. This current is monitored so that when the current value exceeds a predetermined value, it is assumed that the life end is found for the photoconductor sheet, thereby accomplishing the replacement of the photoconductor sheet. In the case where the cap 5 is either a conductive rubber or a metal, the charger control can be effected to minimize the difference between the voltages measured on the cap 5 and on the charge receiving surface by the surface potential detector 9.

Figure 6A:
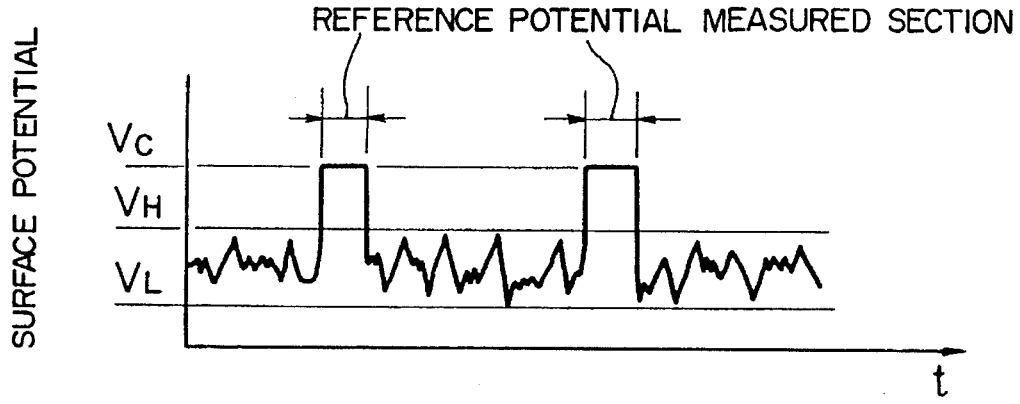
FIGS. 6A, 6B, and 6C are diagrams each showing a variation with respect to time of the measured surface potential of a photoconductor sheet.
Figure 6B:
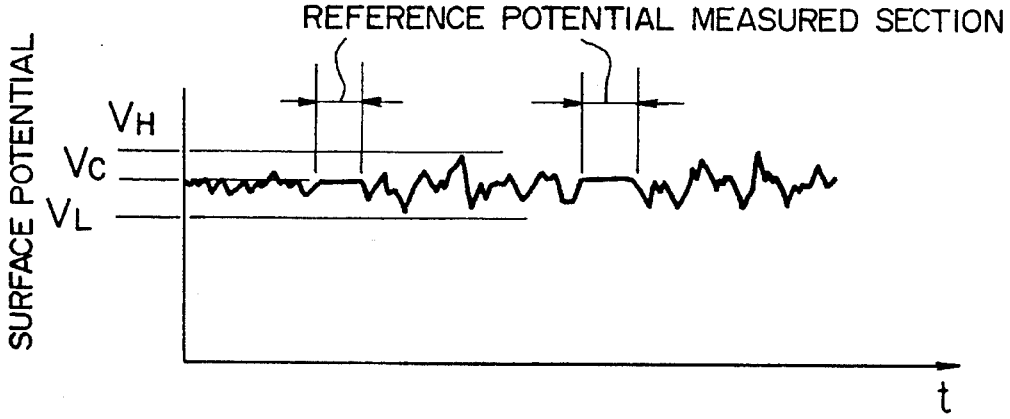
Figure 6C:
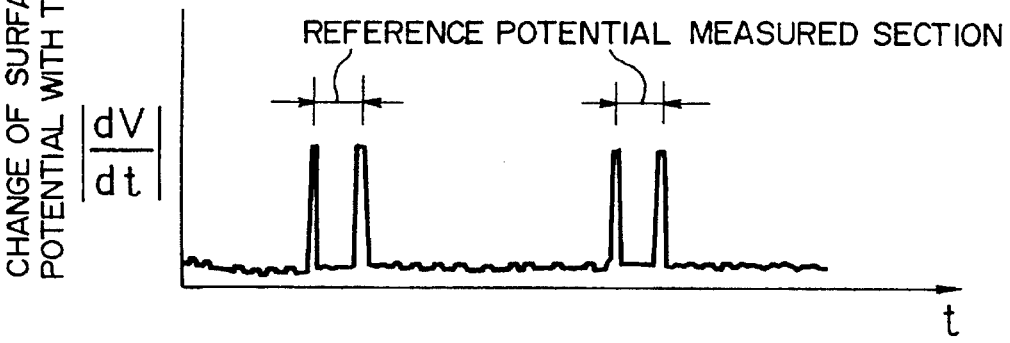

Next, description will be given of a concrete method of controlling the charger. FIGS. 6A to 6C show variations with respect to time of a potential measured by the surface potential detector 9 or a voltage, in which the potential $V_k$ of the cap 5 is set to the voltage $V_S$ for the charge receiving surface. In FIG. 6A, there is shown a case where the output value of the surface potential detector 9 is less than the potential $V_k=V_C$ of the cap 5 as the reference potential measured section. In this case, it is necessary to control the charger 16 to increase the surface potential. As a method of increasing the potential, a control operation is carried out as shown in FIG. 6B such that the following expression is satisfied by the maximum output value $V_H$ and the minimum output value $V_L$ of the surface potential detector 9 and the output $V_C$ of the cap 5:

$$V_C=\alpha\times(V_H-V_L)+V_L$$

where $0\leqq\alpha\leqq1$. In addition, also when the output value of the electrometer or surface potential detector 9 is higher than the potential of the cap as the reference potential measured section, the potential of the charge receiving surface can be set to an appropriate value, by effecting the similar control.

Description will now be given of another method of controlling the charger 16. FIG. 6C shows the variation with respect to time of the signal obtained through a differentiation and rectification of the output value of the surface potential detector 9. When the charge receiving surface potential is equal to the reference potential, the potential in a pulse shape is substantially zero; however, when the charge receiving surface potential is unequal to the reference potential, a pulse voltage is generated before and after the cap 5. When the charger 16 is controlled such that the pulse voltage is reduced to the maximum extent, the charge receiving surface potential can be set to an appropriate value. In a case where the above control of the surface potential becomes to be impossible, it is determined that the photoconductor sheet is to be replaced. More concretely, when the difference between the maximum and minimum values exceeds a preset value, the photoconductor sheet is judged to be replaced.

In addition, in order to determine the end of life of the photoconductor sheet, the number of rotations of the photoconductor drum 4 is experimentally measured from the start of the rotation until the life has ended and when the value experimentally measured is reached in the practical use of the photoconductor sheet, it may be determined that the end of life is found.

Figure 7A:
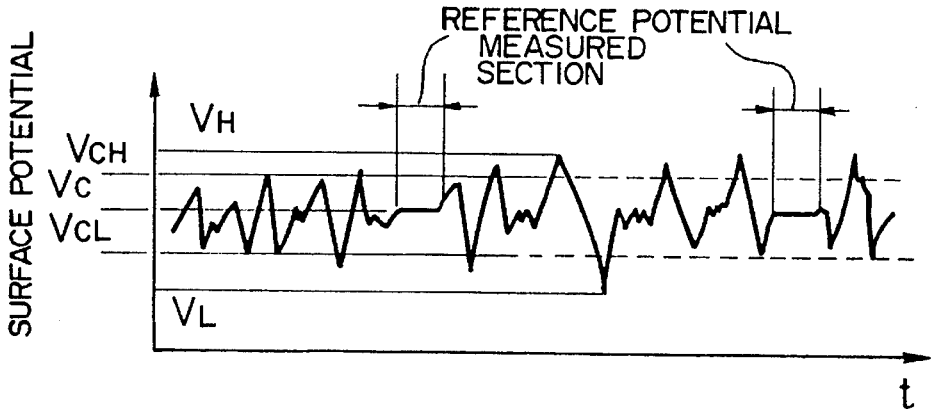
FIGS. 7A and 7B are diagrams each for explaining an example of a charge receiving surface potential measured by a surface potential detector.

FIG. 7A shows, like FIG. 6*a*, an output example of the surface potential detector 9 associated with the charge receiving surface. According to a method of evaluating the life, when the maximum value $V_H$ and the minimum value $V_L$ satisfy the following expression, it is determined that life of the photoconductor sheet has ended:

$$(V_H-V_L)>V_D$$

where $V_D$ is a preset value.

Figure 7B:
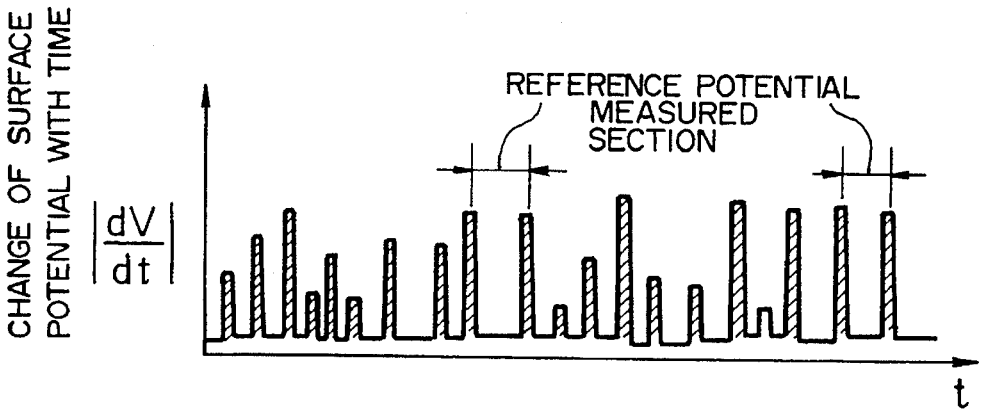

As the second method of evaluating the life of the photoconductor sheet, there may be employed a procedure in which in FIG. 7A, potential values $V_{CH}$ and $V_{CL}$ are respectively set to be the slightly higher and lower values as compared with the output from the surface potential detector 9 associated with the reference potential measured section, and then the number $N_H$ of times when the output from the charge receiving surface exceeds $V_{CH}$ and the number $N_L$ of times when the output from the charge receiving surface is less than $V_{CL}$ are counted in the controller 14 of FIG. 1A, so that when the above counts associated with one rotation of the photoconductor drum 4 exceed a predetermined count $N_G$, it is determined that the life of the photoconductor sheet has ended. In the method of evaluating the life of the photoconductor sheet of this example, there is utilized a waveform obtained by differentiating the measured potential. FIG. 7B shows a variation with respect to time of the values attained by differentiating the output from the electrometer or surface potential detector 9 in a case where the photoconductor sheet is deteriorated. Through the differentiation processing, a location where the surface potential abruptly decreases can be detected; in consequence, it is possible to recognize fatal defects such as a pinhole. That is, when the photoconductor sheet surface becomes to be more deteriorated, there appear a greater number of pulse waveforms. Among these waveforms, the controller 14 monitors the number of pulses other than those associated with the reference potential measured section or the peak values of the pulses. When the number of pulses thus monitored exceeds a predetermined value $N_W$ or when the difference between the maximum and minimum values of the pulse peak values exceeds a reference value $V_W$, it is determined that the life of the photoconductor sheet has ended.

Figure 8A:
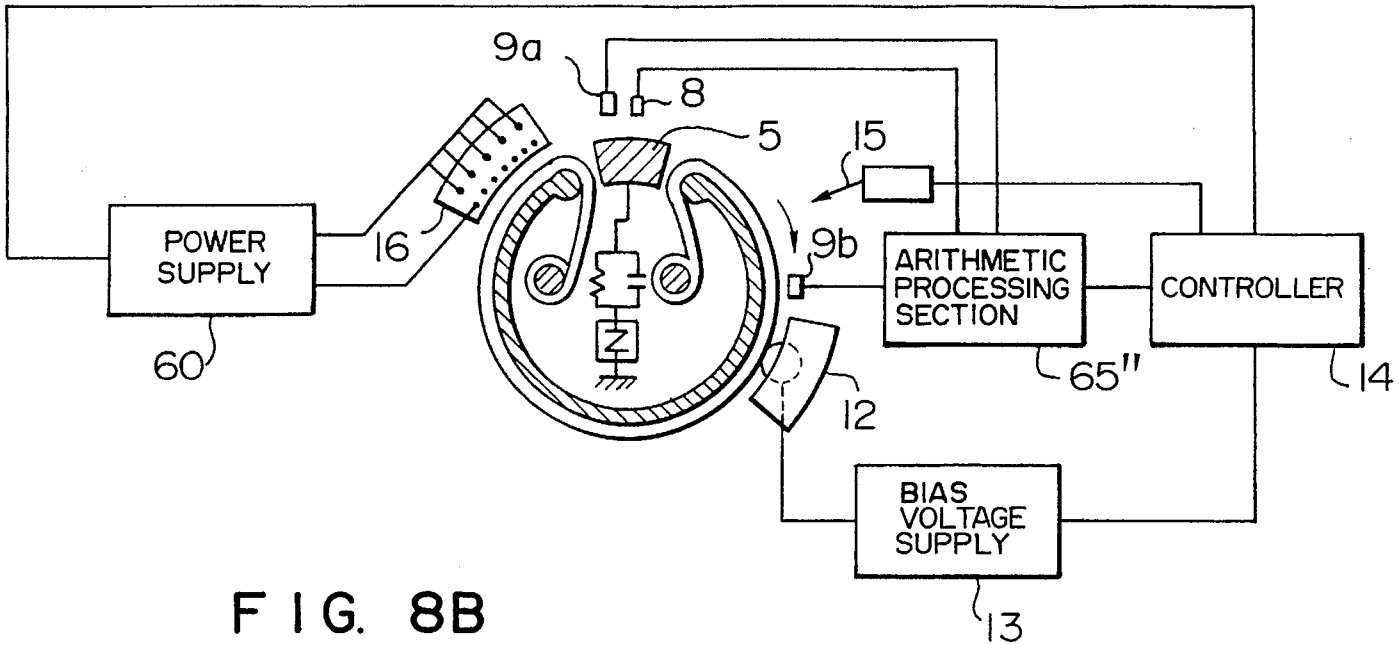
FIGS. 8A and 8B are diagrams showing a control system in which the residual potential of the photoconductor sheet after the exposure is measured to effect a high picture quality control and a life evaluation of the photoconductor sheet in FIGS. 4A and 4B.
Figure 8B:
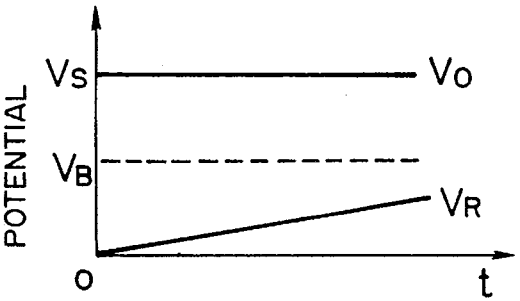

FIGS. 8A and 8B show another embodiment according to the present invention including a second surface potential detector *9b* for measuring the surface potential after the exposure to obtain a residual potential $V_R$. The surface potential detector *9a* is employed to comparatively measure the potential of the cap 5 and the potential of the charge receiving surface after the charging operation, and as described with reference to FIGS. 4A and 4B, the charger 16 is controlled such that the potential of the charge receiving surface is kept retained at the reference value $V_S$ in any situation. However, as shown in FIG. 8B, the surface potential after the exposure effected by the optical system 15, namely, the residual potential $V_R$ increases with a lapse of time (as the value t increases along the abscissa) because of the deterioration of the photoconductor sheet even for the same amount of exposure. The residual potential $V_R$ is measured by the second surface potential detector *9b* to be compared with $V_O$, which is measured by the first surface potential detector *9a*, by the arithmetic processing section 65" such that the controller 14 controls the bias voltage supply 13 of the developer 12 to set the bias voltage $V_B$ to a value less than $V_0$ and greater than $V_R$. As a result, there does not appear the fog in the obtained picture. On the other hand, based on $V_0$ and $V_R$, a contrast potential $\Delta V$ is computed as the difference between $V_0$ and $V_R$ such that when this value $\Delta V$ becomes to be less than a preset value or when $V_R$ becomes to be greater than a predetermined value, the end of life of the photoconductor sheet is determined and then the photoconductor sheet is replaced.

According to this method, since the characteristic of the photoconductor sheet is evaluated also after the exposure, the life evaluation can be accomplished with a higher precision. In the embodiment of FIGS. 8A and 8B, although there are adopted two surface potential detectors *9a* and *9b*, it is also possible to employ only one surface potential detector *9b* so that the exposure is conducted such that the bright and dark states alternatively appear and the potentials $V_0$ and $V_R$ are measured the portions of the photoconductor sheet exposed to be in the dark state and in the bright state, respectively. This provision enables the object to be achieved only with one surface potential detector.

Figure 9A:
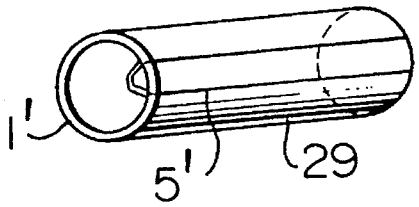
FIGS. 9A and 9B are diagrams each showing a photoconductor drum of the electrostatic recording apparatus to which the present invention is applied.
Figure 9B:
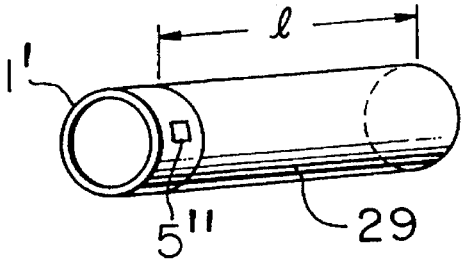

Although the examples above have been described with reference to an electrostatic recording apparatus employing a photoconductor sheet of a so-called sheet wind type in which the photoconductor sheet 2 is wound on the drum 1, the method of evaluating the life of the photoconductor sheet according to the present invention is not limited by those examples but is applicable to other systems. FIGS. 9A and 9B show examples in which the method above is applied to a system of a so-called photoconductor drum type, namely, a charge receiving surface 29 is formed on the surface of the drum 1. FIG. 9A is a case employing drum associated with a sheet of paper and is applicable when the circumferential length of the drum is longer than the width of the sheet of paper, and a reference potential measured section 5' is electrically insulated from a drum 1'. FIG. 7B shows a configuration applicable to a continuous form and to a sheet of paper in which the recording operation can be conducted on a form having a width not exceeding the length l.

Next, another embodiment of an electrostatic recording apparatus according to the present invention will be described below. The description is related to the U.S. Pat. No. 5,373,351. The disclosure of this application is incorporated herein by reference.

Generally, in an electrostatic recording apparatus of reversal development type such as a printer, in order to prevent toner from being attached on the surface of the cap in the development it is necessary to hold a surface potential of a cap to a sufficiently higher voltage than a developing bias voltage and to form a dielectric film on a surface of a metal portion of the cap so as to reduce an image force due to electric charges of toner particles. A method of forming the dielectric film having a volume resistivity of $10^9$ cm or less on the cap surface to reduce the image force by electric charges of toner particles has been proposed in JP-A-2-12571 by inventors including three of the inventors of the present invention.

In order to hold the surface potential of the cap to the sufficiently higher voltage than the developing bias voltage, there is a method of connecting a capacitor between the cap and the ground and charging the capacitor through a charging current from a charger to apply the charged-up potential to the cap, as described above. This method has merit in that a new power supply is not required. In this method, when the volume resistivity of a dielectric film formed on the cap surface is equal to $10^9$ Ωcm or less and a thickness of the film is in a range from 20 to 100 μm, a resistance of the film is equal to 100 KΩ or less. In this case, when the resistance of the film is increased, the charging current is reduced and the charging speed is influenced. Further, a potential of the surface of the cap depends on the charging current, a charging time and a capacitance of the capacitor.

Figure 22A:
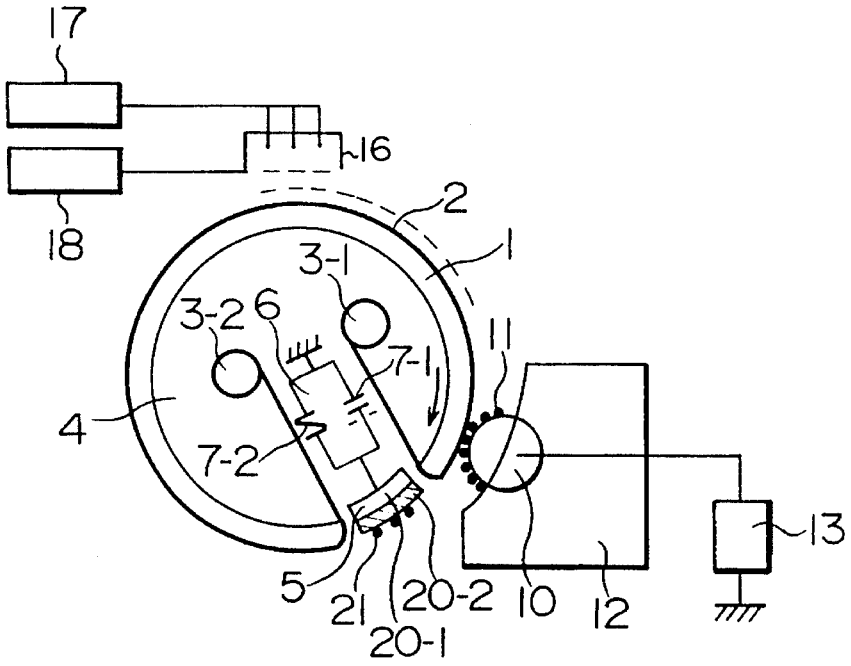
FIGS. 22A and 22B are diagrams showing a conventional method of charging a capacitor by a charging current from a charger to apply a potential to a cap.
Figure 22B:
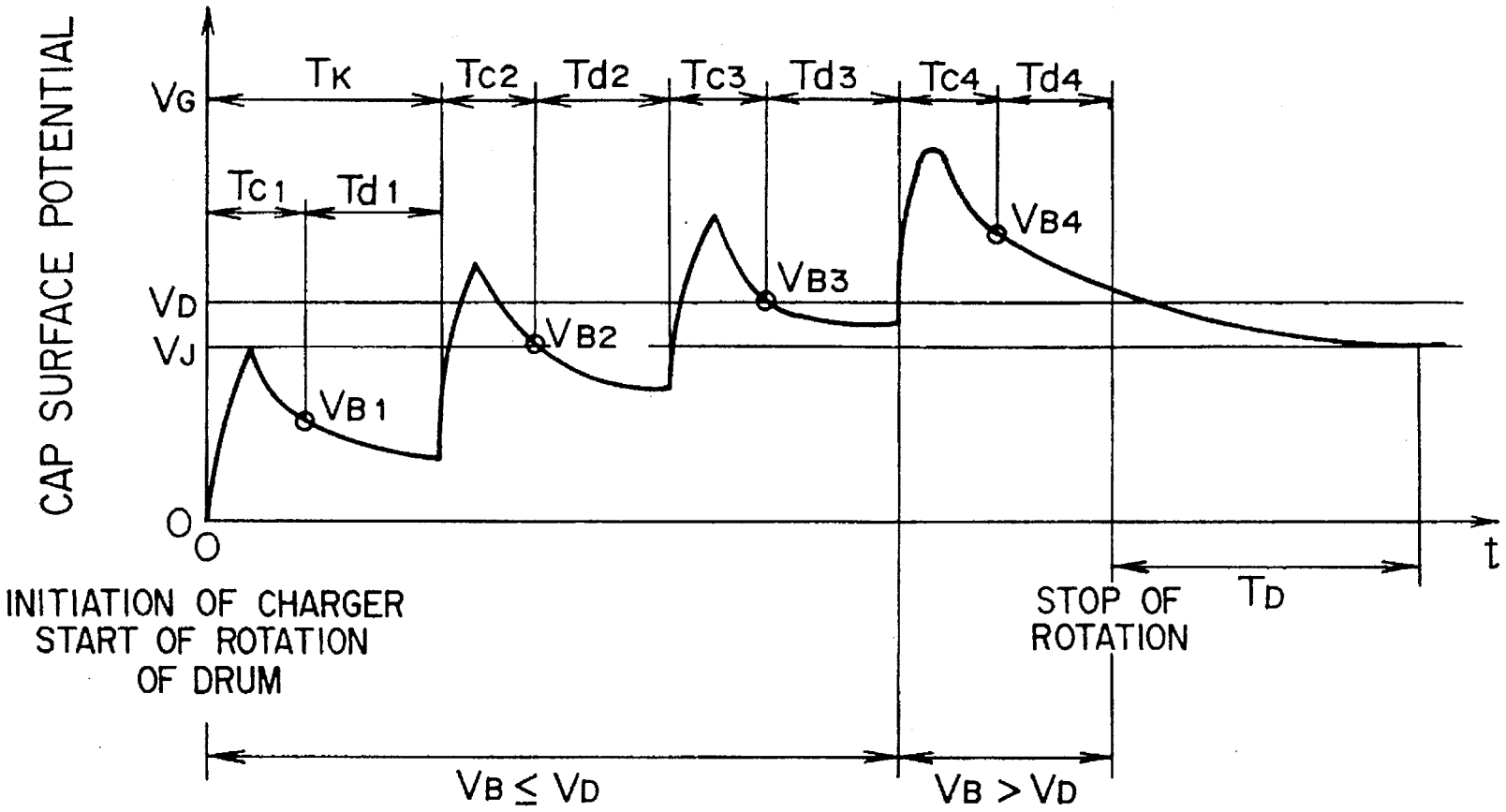

This method is now described with reference to FIGS. 22A and 22B. It is assumed that any electric charge is not stored in the capacitor 7-1 before start or during standstill of the electrostatic recording apparatus. When the electrostatic recording apparatus is started so that the drum begins to be rotated and the cap 5 passes under the charger 16 connected to high voltage supplies 17 and 18, a charging current through corona discharge flows to charge the capacitor 7-1. At this time, when a charging current flowing into the photoconductor drum 4 from the charger 16 is $I_d$, a charging current of the capacitor 7-1 is $I_j$, a charging time is $T_j$, and a capacitance of the capacitor 7-1 is $C_j$, a potential $V_c$ of the capacitor 7-1 (equal to a surface potential of the cap 5) is given by $$V_c = \left( \int_0^{T_j} I_j dt \right) / C_j \tag{1}$$

When a moving speed of the drum 4 is $v_d$, a width of the charger 16 is $W_c$, and a width of the cap 5 is $W_d$, the charging time $T_j$ and the charging current $I_j$ are expressed by $$T_j = W_c / v_d \tag{2}$$

$$I_j = I_d \times (W_d / W_c) \tag{3}$$

That is, the voltage $V_c$ of the capacitor 7-1 is inversely proportional to the capacitance $C_j$ of the capacitor 7-1 and the moving speed $v_d$ of the drum and is proportional to the width $W_d$ of the cap 5 and the charging current $I_d$. Accordingly, when the apparatus is operated at a high speed and the moving speed $v_d$ is increased, the charging time $T_j$ is made short and when it is considered to make the apparatus small, the width $W_d$ of the cap is also made narrow. However, it is not preferable for deterioration of the photoconductor and increased capacity of the power supply to increase the charging current $I_d$ excessively in order to charge the capacitor 7-1 rapidly.

On the other hand, as the cap 5 is apart from the charger 16, the charge stored in the capacitor 7-1 is leaked through the voltage control element 7-2 connected in parallel with the capacitor and the potential of the surface of the cap 5 is reduced. FIG. 22B shows a variation of the surface potential of the cap 5. When a time required for one rotation of the photoconductor drum 4 is $T_k$, the surface potential $V_c$ of the cap 5 is increased gradually and in a step manner while repeating its increase and reduction. In FIG. 22B, $T_c$ is a time until the cap 5 reaches the developer 12 after the cap 5 comes under the charger 16, $T_d$ is a time until the cap comes under the charger 16 again after the cap comes out from the developer 12, and $V_G$ is a voltage of a grid of the charger 16. A potential $V_B$ of the cap 5 at the time when the cap passes under the developer 12 is gradually increased to $V_{B1}$ in a first rotation, $V_{B2}$ in a second rotation, $V_{B3}$ in a third rotation and $V_{B4}$ in a fourth rotation.

When the cap potential is varied as above, some problems occur as follows:

(1) Attachment of Toner on the Cap Surface

When a bias voltage of the developer 12 is $V_D$, the potential or voltage $V_B$ of the cap is equal to or smaller than the bias voltage $V_D$ when the drum 4 is rotated three times. Accordingly, the cap 5 is developed and toner 21 is attached on the cap surface. Since the attached toner is removed by a cleaner, consumption of toner increases and scattered toner during the rotation of the drum contaminates paper and the interior of the apparatus.

(2) Electric Shock

There is a case where the photoconductor drum 4 is stopped suddenly due to a jam of paper or a failure of a printer to remove paper wound on the drum 4 or examine the drum. In this case, electric charges remain in the capacitor of the cap even after a time $T_D$ from stop of the drum 4 and the surface potential of the cap is $V_j$. Accordingly, when the potential $V_j$ is high, an electric shock occurs due to contact with the cap 5.

(3) Influence of Step between the Cap and the Photosensitive Drum

Since there is a step between the surface of the cap 5 and the surface of the photoconductor drum 4, i.e., the cap is at a different outer radius with respect to the center of the drum than the surface of the drum there is a case where a flaw is produced on the surface of a belt pressed on the drum 4 by a roller when a belt transfer system is employed. Accordingly, there is a possibility that image quality is degraded and the belt is deteriorated. Further, there is a problem in view of retention of a uniform developing gap.

Figure 10:
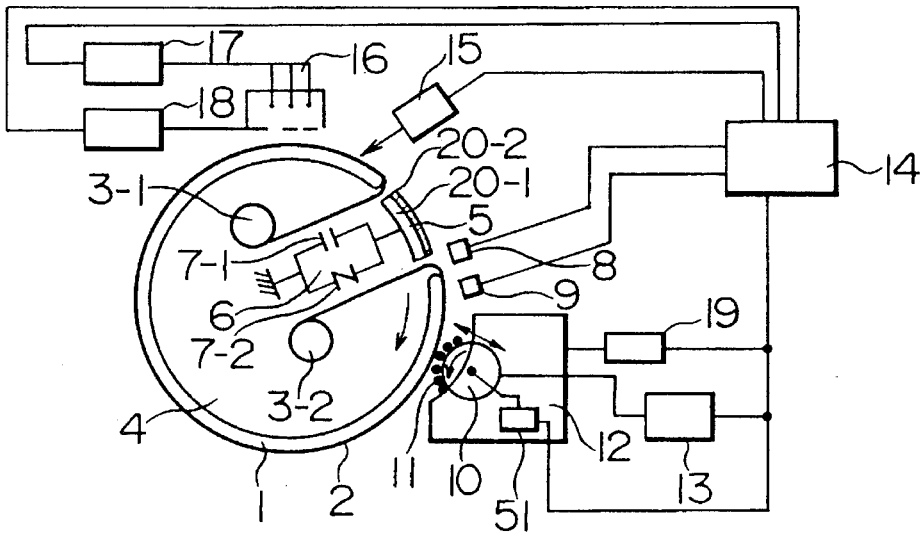
FIG. 10 is a diagram showing another embodiment of an electrostatic recording apparatus according to the present invention in which a developer is retracted.

FIG. 10 schematically illustrates an electrostatic recording apparatus according to an embodiment of the present invention. In the embodiment, the developer roll 10 is retracted so that a developing agent 11 is not attached to the cap 5 until a potential of the cap 5 is increased to a predetermined value.

In the embodiment of the present invention shown in FIG. 10, a parallel circuit 6 of a capacitor 7-1 and a varistor 7-2 is connected between a ground and the cap 5 of aluminum disposed in the opening of a photoconductor drum 4 including a drum 1 of aluminum having a surface on which the photoconductor sheet 2 is wound. An aluminum enameled film 20-2 having a volume resistivity of $10^9$ Ω or less is formed on a surface of a metal portion 20-1 of the cap 5. Formation of the dielectric film 20-2 on the cap surface is described in U.S. Pat. No. 5,128,719. The disclosure of the patent is incorporated herein by reference. The charger (scorotron) 16 includes corona wires and a grid to which high voltages of the high voltage supplies 17 and 18 are applied in accordance with an instruction from the controller 14, respectively. The photoconductor sheet 2 and the capacitor 7-1 are electrified or charged by corona charge produced by the charger 16. The position detector 8 detects a position of the cap 5 of the drum 4 and the potential detector 9 detects a surface potential of the cap 5 to apply the respective detection signals representative of detected results to the controller 14.

The developing roll 10 provided in the developer 12 and having a surface on which a developing agent layer 11 is formed is applied with a bias voltage from the bias voltage supply 13 in accordance with an instruction from the controller 14. The retracting mechanism 19 is coupled with the developer 12 and a position of the developer 12 is controlled in accordance with an instruction from the controller 14. More particularly, the controller 14 monitors a potential $V_B$ of the surface of the cap 5 by the detector 9 provided in the vicinity of an entrance or inlet of the developer 12. The retracting mechanism 19 is operated to retract the developer 12 and as a result the developing roll 10 so that the developing agent layer 11 does not come into contact with the cap surface until the potential $V_B$ is increased to a predetermined value, for example, a sufficiently larger value than a voltage $V_D$ of the bias voltage supply 13. Thus, attachment of toner to the surface of the cap 5 can be prevented. If the retracting operation is canceled when the potential $V_B$ exceeds the potential $V_D$, the recording apparatus can perform the normal recording operation thereafter.

In the foregoing description, the predetermined value for the surface potential of the cap 5 may be selected to be substantially the same value as the surface potential of an unexposed portion of the photoconductor. Further, the developing agent used may be any of one component developing agent using only toner or two-component developing agent using toner and carrier.

Figure 11A:
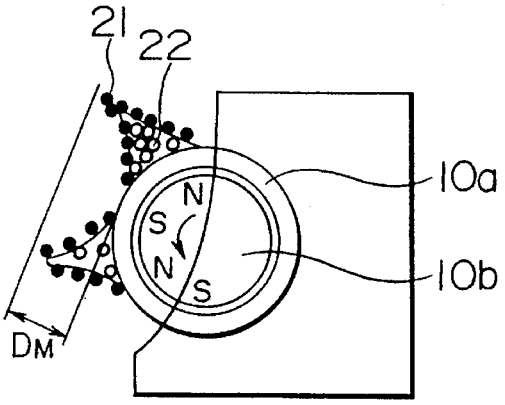
FIGS. 11A and 11B are diagrams each showing controlled height of bristle.
Figure 11B:
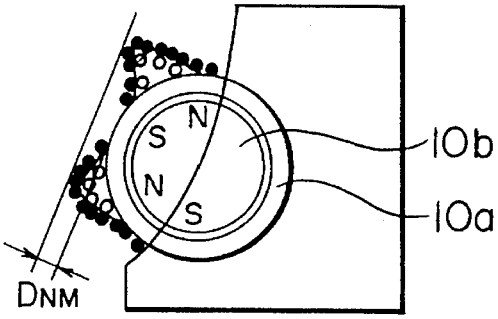

As shown in FIGS. 11A and 11B, when the two-component developing agent including toner 21 and carrier 22 is employed, the developing roll 10 includes a sleeve roll 10*a* and a magnetic roll 10*b*. The developing agent is fed to a developing position through rotation of the sleeve roll 10*a*. A height $D_M$ of the developing agent at the developing position at this time is called a height of bristle. The height $D_M$ becomes to be a height $D_{NM}$ when the developing roll is stationary. The nature of the height of bristle of the above developing agent is employed to control rotation of the developing roll 10 so that the developing agent comes into contact with the photoconductor 2 when the developing roll is rotated and the developing agent does not come into contact with the photoconductor 2 when the developing roll 10 is stationary. More particularly, the controller 14 monitors the potential $V_B$ of the surface of the cap 5 and controls a roll rotation driving section 51 to stop rotation of the developing roll 10 until the potential $V_B$ is increased to a predetermined value, for example, a sufficiently larger value than the voltage $V_D$ of the bias voltage supply 13. Thus, attachment of toner to the surface of the cap 5 can be prevented.

In this connection, when a necessary time (necessary rotational number) for increasing the surface potential $V_B$ of the cap 5 to be larger than the potential $V_D$ is predetermined, the rotation driving section 51 may be controlled to stop rotation of the developing roll until the necessary time (necessary rotation) elapses after rotation of the drum 4 has been started.

Figure 12A:
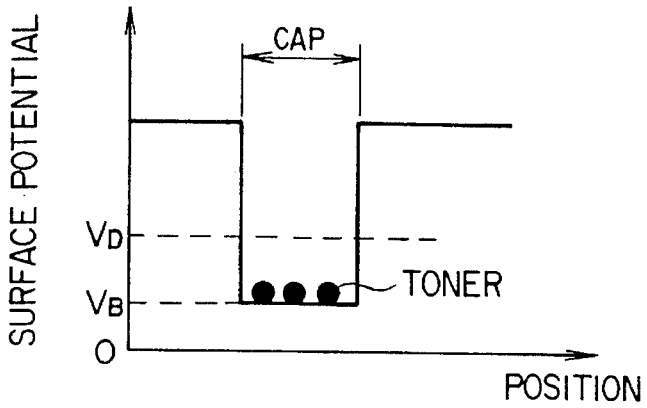
FIGS. 12A and 12B are diagrams each showing a controlled bias voltage of a developer.
Figure 12B:
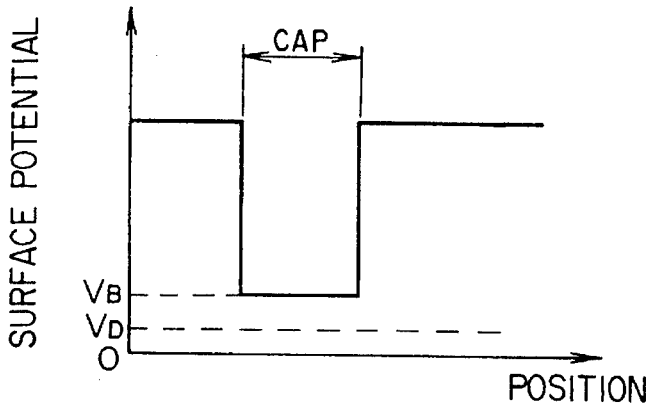

When the Teflon resin film 20-2 (volume resistivity of $10^8$ Ωcm) having carbon added thereto is formed on the surface of the cap 5, the volume resistivity of the film 20-2 can be varied by changing an amount of added carbon. In the case of the reversal development system, when the developing bias voltage $V_D$ is higher than the surface potential $V_B$ of the cap, toner is attached to the surface of the cap. FIG. 12A shows the fact that toner is attached to the surface of the cap having the potential $V_B$ in the case of $V_D>V_B$ and FIG. 12B shows the fact that toner is not attached to the surface of the cap having the potential $V_B$ in the case of $V_D<V_B$.

The capacitor 7-1 connected to the cap 5 is charged by the current flowing into the cap 5 from the charger 16. The controller 14 monitors the charged potential of the unexposed portion of the charge receiving surface of the photoconductor sheet 2 and the surface potential $V_B$ of the cap 5 by means of the detector 9 and sets the developing bias voltage $V_D$ to a sufficiently lower value than the potential $V_B$ of the surface of the cap 5 until the surface potential $V_B$ is substantially equal to the charged potential of the unexposed portion of the charge receiving surface of the photoconductor 2. That is, the bias voltage supply 13 is controlled to make reverse bias. Thus, attachment of toner to the surface of the cap can be prevented.

A method of removing electric charges stored in the capacitor 7-1 connected to the cap 5 will be now described.

Figure 13:
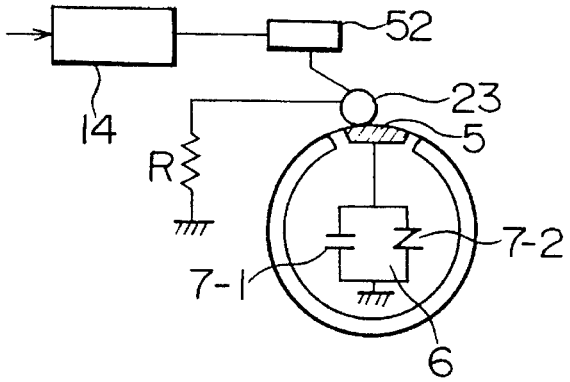
FIG. 13 is diagram showing discharge of electric charges from a cap.

As shown in FIG. 13, upon stop of the drum 4, a contactor 23 connected to a ground potential is brought into contact with the cap 5 by a contactor driver 52 in accordance with an instruction from the controller 14 to remove or discharge electric charge stored in the capacitor 7-1. The contactor 23 is usually retracted by the driver 52 and when there is a possibility that a human body comes into contact with the photoconductor drum 4 for the purpose of repair of a jam of paper, exchange of the drum or the like, the driver 52 is controlled in accordance with a discharge control signal from the controller 14 generated on the basis of signals such as a signal from a safety switch or the like or an instruction signal from a user so that the contactor 23 is brought into contact with the cap 5. In this case, it is necessary to stop the cap at a position in which the cap is opposed to the contactor 23 when the drum is stopped. In order to prevent occurrence of electric spark upon the contact, a resistor may be connected between the contactor 23 and the ground. However, as in the embodiment, when the hard dielectric film 20-2 such as an aluminum oxidized or aluminum enameled film is formed on the surface of the cap 5, a new resistor is not required.

Figure 14A:
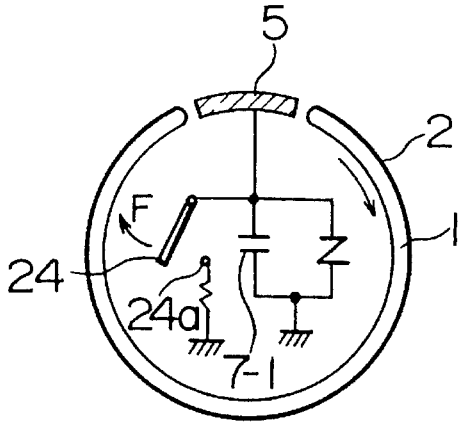
FIGS. 14A and 14B are diagrams each showing a method of controlling discharge of electric charges of a capacitor by utilizing centrifugal force.
Figure 14B:
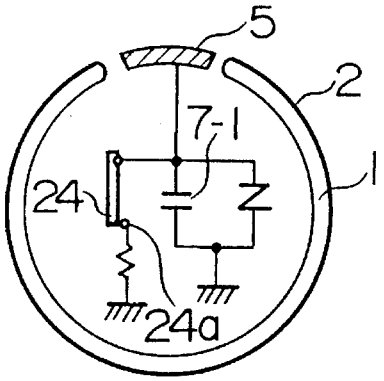

As another method of discharging electric charge of the capacitor 7-1 automatically, as shown in FIGS. 14A and 15B, there is provided a contact shoe 24 having one end electrically connected to the cap. As shown in FIG. 5A, the contact shoe 24 is separated or apart from a ground terminal 24*a* with centrifugal force F during rotation of the drum. When the drum is stopped, the contact shoe 24 comes into contact with the ground terminal 24*a* as shown in FIG. 14B to remove the electric charge of the capacitor 7-1. In this case, the electric charges can be discharged exactly by pulling the contact shoe 24 in the opposite direction to the centrifugal force F by a spring having relatively weak force even if the drum 4 is stopped at any position.

Figure 15:
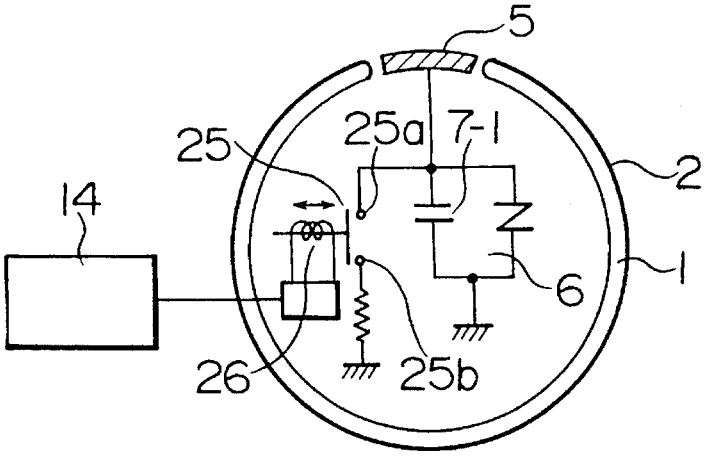
FIG. 15 is a diagram showing a method of controlling discharge of electric charges of the capacitor by an external instruction by means of a switch.

In a method shown in FIG. 15, a magnet switch 26 is disposed within the drum 4 and one end of a switch terminal is connected to the cap 5 through a contact 25*a* with other end thereof being connected to the ground through a contact 25*b* and a resistor. When the drum 4 is stopped, a current flows in the magnet 26 in response to an instruction from the controller 14 so that the switch terminal 25 connects between the cap 5 and the ground and electric charge stored in the capacitor 7-1 is removed. This example has merit that the electrical control can be more easily made as compared with the methods shown in FIGS. 13, 14A and 14B.

The methods of FIGS. 13 and 15 of the present invention described above can be performed in response to a request for removal of electric charges upon repair of a jam of paper and exchange of the drum. After a fixed period of time from issuance of the request has elapsed, a signal indicating that the door of the apparatus is operable can be sent to a monitor to display that removal of electric charges has been completed. More certainly, the surface potential of the cap is measured by the detector 9 and after it is confirmed that the measured value is reduced to a sufficiently low value so that electric shock does not occur even if a human being comes into contact with the cap, the openable signal may be sent to the monitor of the electrostatic recording apparatus. Further, the openable signal can be sent to an information processing apparatus such as, for example, a computer, a word processor, a personal computer and a work station using the electrostatic recording apparatus so that the openable signal can be displayed in a display unit thereof.

Figure 16A:
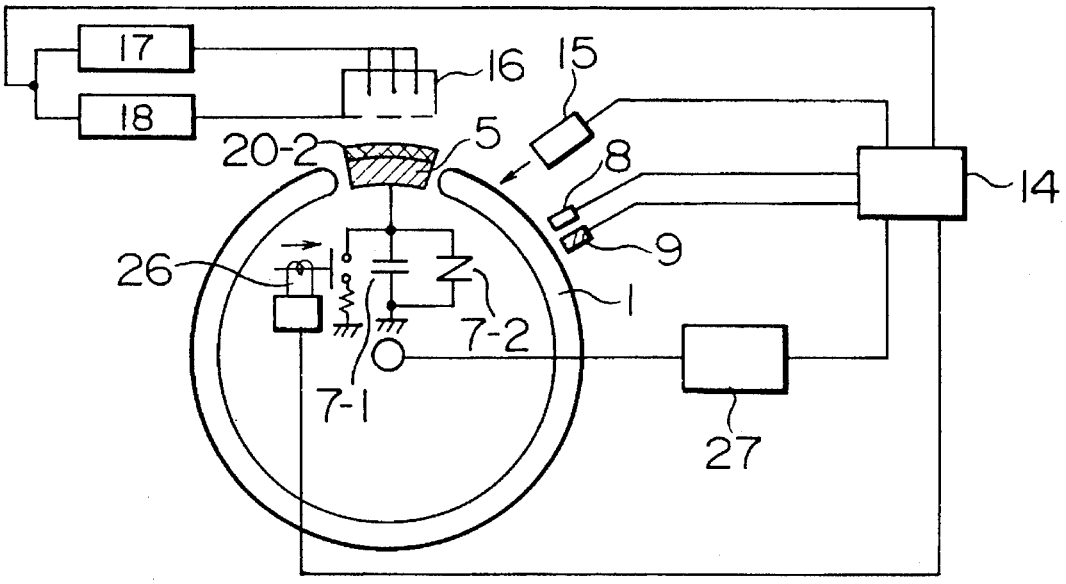
FIGS. 16A and 16B are diagram showing a method of shortening a charging time of the cap by controlling a stop position of a drum.
Figure 16B:
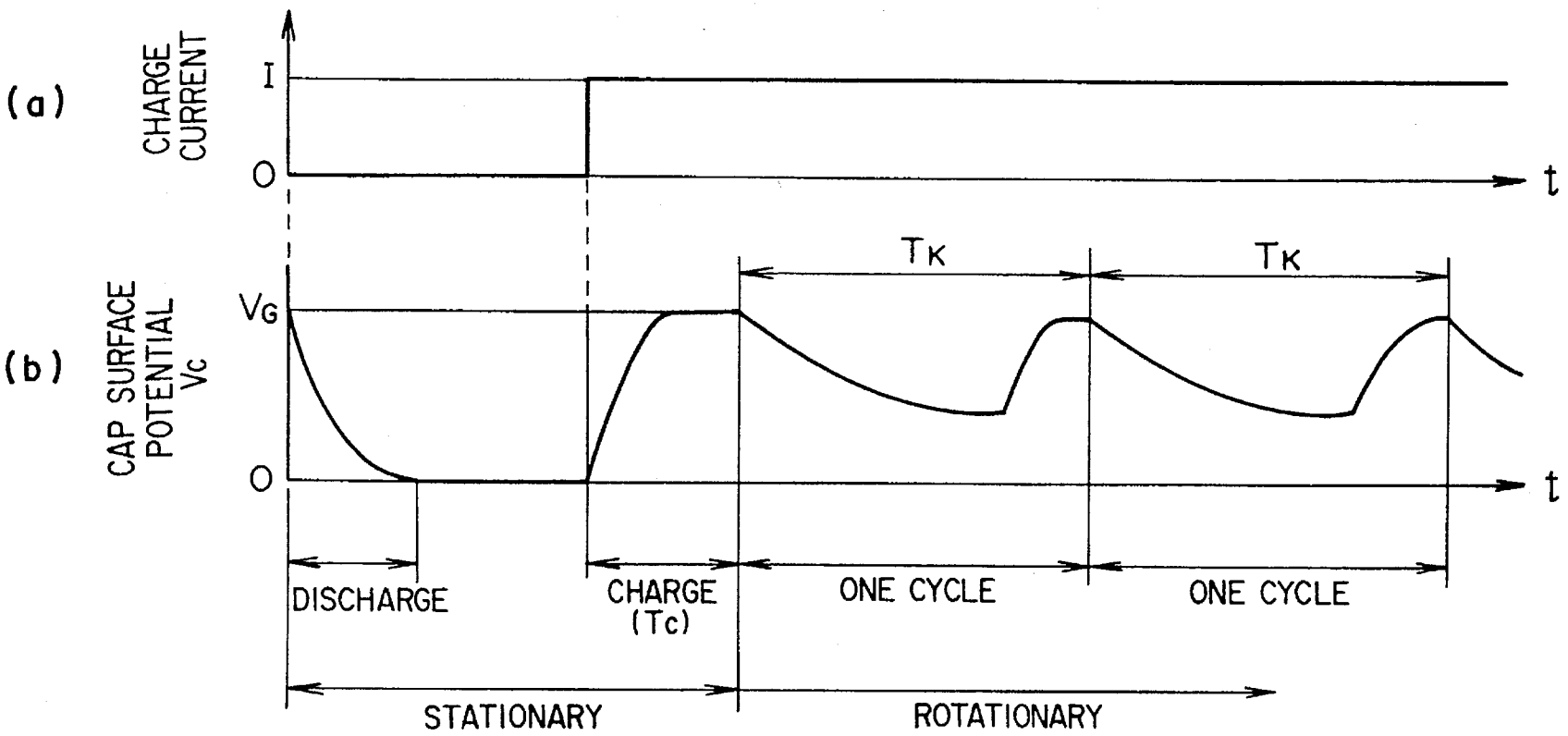

In an example shown in FIGS. 16A and 16B, a method of controlling discharging and charging of the capacitor 7-1 connected to the cap 5 is shown. As shown in FIG. 16A, it is assumed that instructions for repair of a jam of paper or exchange of the drum are sent from the controller 14 to a controller 27 for a drive motor of the photoconductor drum 4 and the charger power supplies 17 and 18 and rotation of the drum drive motor and operation of the charger are stopped. At this time, the drum 4 is stopped in accordance with a detected result of the position detector 8 so that the cap 5 is positioned under the charger 16. A current then flows into the magnet switch 26 and the contactor 25 connects between the cap 5 and the ground terminal so that electric charge stored in the capacitor 7-1 is discharged.

When the repair of jam of paper or the exchange of the drum has been completed and the apparatus is instructed to initiate its operation, electric power is supplied to the charger 16 from the power supplies 17 and 18 so that the charger 16 initiates corona discharge. Thus, a discharge current $I_d$ flows in the cap 5 to charge the capacitor 7-1. The cap potential $V_c$ is increased to a predetermined potential after an elapse of a fixed time $T_C$. This potential is determined by a grid voltage and a varistor voltage. Then, the drum 4 begins to be rotated and the printing operation is started.

In this example, since the capacitor is controlled to be charged before the start of rotation of the drum as described above, the cap can be charged rapidly and a return to the printing operation can be made more quickly. In this case, it is also possible to return to the printing operation after the surface potential of the cap 5 has been confirmed by means of the potential detector 9, that is, after one rotation of the drum 4. Since the exposure is made after the cap 5 has passed through the exposure unit 15, when a rotation period of the drum is $T_k$, the potential of the cap 5 is never reduced to the bias voltage or less of the developer 12 during its operation though the cap potential is changed as shown in FIG. 16B by repeated self-discharge through the varistor 7-2 and charge by the charger. In this example, since the cap 5 is stopped under the charger 16 and the capacitor 7-1 is charged, a width of the cap 5 is required to be wider than that of the charger 16 in order to prevent the photoconductor 12 from being damaged, and this configuration is suitable for such an electrostatic recording apparatus.

Figure 17:
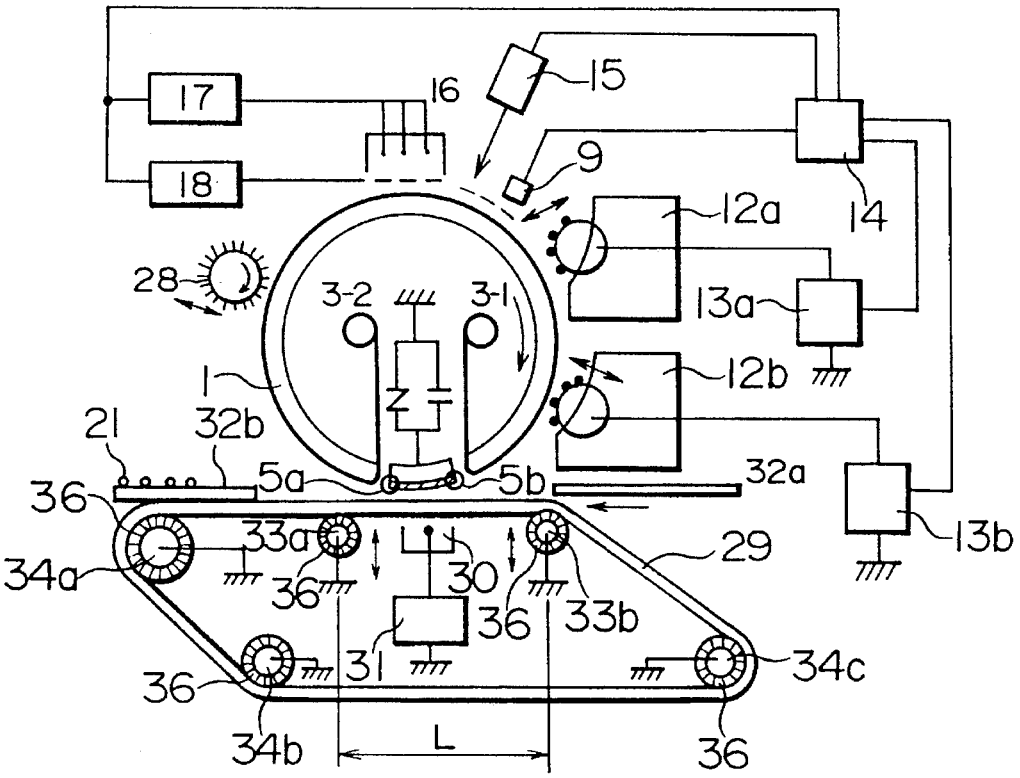
FIG. 17 is a diagram showing an electrostatic recording apparatus of belt transfer type capable of effecting two-color printing.

Referring now to FIG. 17, an electrostatic recording apparatus using the photoconductor drum of photoconductor sheet wound type and a belt transfer system will be described. The electrostatic recording apparatus includes two developers 12*a* and 12*b* and can effect two-color printing by two rotations of the photoconductor drum 4. In FIG. 17, the developers 12*a* and 12*b* are configured such that rotation of the developer roll 10 or to control the developer bias voltage is controlled or that the developers 12*a* and 12*b* can be retracted. The printing operation is started when the potential of the cap 5 reaches a sufficiently high value which is substantially equal to the surface potential of the photoconductor 2.

Development for the first color is made by the first developer 12*a* and a toner image of the first color is formed on the photoconductor 2. Though the photoconductor drum 4 is rotated and passes under the second developer 12*b*, a transfer belt 29 and a cleaner 28, since these units are retracted, the toner image of the first color is not scratched off and the photoconductor drum 4 passes under the charger 16 again to be charged. Then, after an exposure for the second color has been made by the exposure unit 15, the photoconductor drum 4 passes under the retracted first developer 12*a* and a toner image of the second color is formed by the second developer 12*b* returned from the retracted state. Thus, the two-color toner image is formed on the photoconductor drum 4 with two rotations of the photoconductor drum as described above. Thereafter, the retracted transfer belt 29 is released from its retracted state under control of the controller 14 and a sheet of paper 32*a* is pressed on the photoconductor drum 4 so that the toner image is transferred onto the sheet of paper 32*a*. In this case, the development for the second color is made in the noncontact manner by the second developer 12*b* in order to prevent color mixture. It is preferable that rotation of the developer roll of the retracted developer is stopped in order to prevent scattering of carrier. In addition, the development order may be changed so that the development for the first color is made by the second developer and the development for the second color is made by the first developer.

In the foregoing description, a charger 30 serves to apply electric charge to the transfer belt 29 and is connected to a DC voltage supply 31 having the opposite polarity to that of toner. This example includes a removing unit of remained electric charge on the transferred paper, a cleaner of the belt and the like in addition to the above-described units, while these are omitted in FIG. 17.

In order to transfer the toner image on the photoconductor 2 to the paper, the transfer belt 29 retracted in the first rotation of the photoconductor drum 4 is required to be pressed onto the photoconductor drum 4 by press rollers 33*a* and 33*b* to thereby secure a nip region of the drum and the belt. In order to avoid the transfer belt 29 from being flawed by the cap 5, it is necessary that the press rollers 33*a* and 33*b* do not press ends 5*a* and 5*b* of the cap through the transfer belt 29, that is, the transfer belt 29 is not pressed onto the cap 5 during passage of the cap 5. As methods therefor, the following two methods can be used.

(1) A distance L between the press rollers 33*a* and 33*b* is made wider than the width of the cap 5. In other words, a width of the nip region is made wider than the width of the cap 5.

(2) When passage of the end 5*b* of the cap 5 through a position of the press roller 33*a* is detected by the controller 14 on the basis of an output of the position detector 8 and an output of the controller 27 of the drive motor of the drum 4, the retracting mechanism (not shown) is operated in response to an instruction from the controller 14 to press the transfer belt 29 onto the photoconductor drum 4 by means of the press rollers 33*a* and 33*b*. As a result, it can be prevented by the above methods to press the press rollers 33*a* and 33*b* to the edge portions of the cap 5 through the transfer belt 29. Thus it can be prevented to damage the belt 29 mechanically by a gap or a step between the metal drum 1 and the cap 5.

Figure 18:
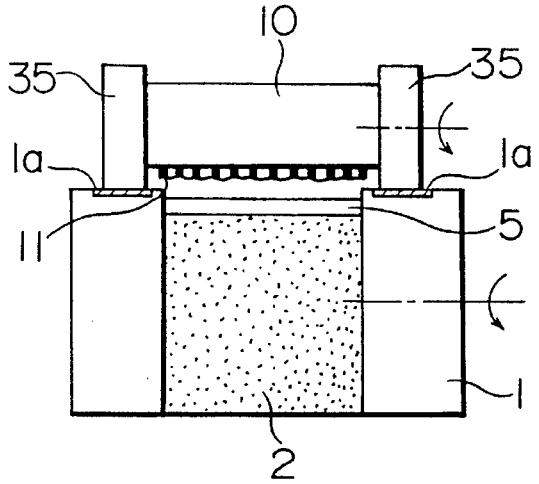
FIG. 18 is a diagram showing a developer capable of effecting noncontact development.

FIG. 18 schematically illustrates a shape of the drum 4 and the developer 12 for securing the developing gap. Hereinafter, when a toner image of a plurality of colors is formed on the photoconductor drum 4, the developer 12*b* for the second color and the subsequent color uses a noncontact developer. In the case of the noncontact development, it is necessary to maintain a predetermined distance or gap between the surface of the developer roll 10 and the surface of the photoconductor 2. This distance is about 0.05 to 0.3 mm for one-component developing agent and about 0.1 to 0.5 mm for two-component developing agent.

In the electrostatic recording apparatus of the present invention, in order to secure the distance between the surface of the developer roll 10 and the surface of the photoconductor 2, a roller 35 for defining the gap is provided to the developing roller 10 of the developer 12. Further, since the cap 5 of the drum 4 is detachable, there is a case where a step is formed between the drum 4 and the cap 5. Accordingly, in order to prevent the roller 35 from being influenced by the step when the roller 35 is moved on the cap 5 a length of the drum 1 is made longer than that of the cap 5. Furthermore, when the surface of the cap 5 is projected above the surface of the drum 4, the surface of the developing roller 10 is flawed and accordingly the surface of the cap 5 is depressed 0.1 to 0.5 mm lower than the surface of the drum 4 in order to prevent the developing agent layer from coming into contact with the cap 5.

On the other hand, since the roller 35 is rotationally moved on the surface of the end of the drum 1, the uniformity of the gap is reduced if toner or carrier is attached to a contact portion of the drum 1 and the roller 35. Particularly, since toner and carrier scattered from the developer have electric charges, if such charged toner or carrier is attached on the metal portion such as the drum 1, mirror force acts greatly and it is difficult to remove the attached toner or carrier. For this reason, dielectric film la is formed on the surface of at least an area of the drum 1 on which the roller 35 is moved. When material of the drum 1 is aluminum, the dielectric film la can be formed through an alumite treatment. Alternatively, aluminum enameled film may be formed. Similarly, dielectric film can be formed on the surface of the belt press rollers 33*a* and 33*b* and the belt drive roller 34*a* and 34*b* to prevent attachment of toner or carrier to these rollers. Thus, phenomenon whereby the carrier is scattered between the belt and the rollers damages the belt can be prevented. The dielectric film used here may be of a low dielectric constant and its volume resistivity may be high or may be as low as that of the dielectric film formed on the surface of the cap.

As shown in FIG. 17, a sheet of paper 32*b* having a toner image 21 transferred thereon is carried by means of the transfer belt 29, separated at a position of the drive roller 34*a*, and fed to a fixer not shown. When the sheet 32*b* is separated from the belt, there is a problem that the toner of the image 21 is scattered from the sheet 32*b* since electric discharge is generated in the gap between the sheet and the belt (separation discharge). However, when the dielectric film is formed on the surface of the drive roller 34*a*, an electric field within the gap between the sheet 32*b* and the belt 29 can be reduced and consequently the separation discharge can be removed since the dielectric film possesses an effect of a capacitor. Thus, scattering of toner can be prevented and deterioration of image and contamination in the apparatus are removed.

Figure 19:
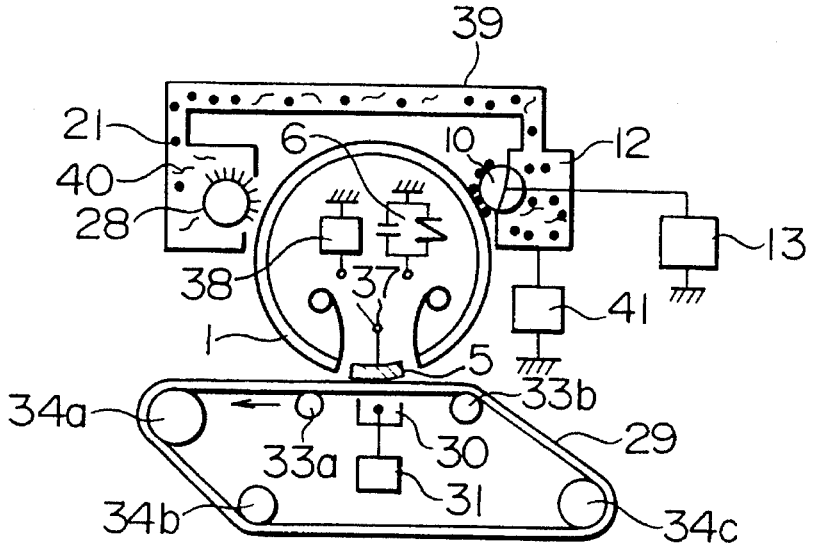
FIG. 19 is a diagram showing a method of withdrawing toner and examining a state of withdrawn toner.

FIG. 19 schematically illustrates an electrostatic recording apparatus having the cap 5 of the drum 4 serving as a current detection electrode. In FIG. 19, the parallel circuit 6 of the capacitor 7-1 and the varistor 7-2 and a current detection circuit 38 are provided within the drum 1 in the same manner as the above-described example. A switch 37 is provided between the cap 5 and these circuits 6 and 38 and the switch 37 switches connection of the current detection circuit 38 and the parallel circuit 6 in response to an instruction from the controller 14. The switch 37 usually connects the parallel circuit 6 to the cap 5, while when the cap 5 is used as the current detection electrode, the switch 37 connects the current detection circuit 38 to the cap 5. In the example shown in FIG. 19, the cap 5 is brought into contact with the transfer belt 29 so that a current flowing in the cap 5 through the transfer belt 29 from the charger 30 is detected. The detected result is supplied to the controller 14.

Usually, since the transfer belt 29 is subjected to the corona discharge during operation and is worn mechanically, the transfer belt 29 is deteriorated and its resistance is reduced. Accordingly, if the current detection circuit 38 is connected to the cap 5 periodically and the current flowing in the cap 5 through the transfer belt 29 from the charger 30 is detected, the detected current value is increased due to deterioration of the transfer belt 29. The current detection circuit 38 may be provided within the photosensitive drum as in this example or outside of the drum.

The current value is monitored by the controller 14, and when the value exceeds a predetermined value, it is judged that the transfer belt reaches the end of its lifespan and a signal representative of exchange of the belt can be issued or displayed on a display unit not shown. In this case, the drum 4 is stopped so that the cap 5 under the belt 29 in contact with the belt 29 or in a very narrow gap and the current detection circuit may detect an average current over one rotation of the belt or may detect a maximum value. The belt drive rollers 34*a*, 34*b* and 34*c* can be driven by a drive motor (not shown) in response to an instruction generated by the controller 14 which responds to a belt state detection command inputted therein. Further, the controller 14 may perform setting, adjustment and control of the power supply 31 for the charger 30 on the basis of a detected value of the current flowing in the cap 5. In addition, since the cap 5 is possibly in contact with the developing agent layer of the developer 12 by, for example, control of rotation of the developer roll 10, if a monitoring period is provided periodically or in response to an inspection command inputted to the controller 14 and the drum is stopped so that the cap 5 is opposed to the developing roller 10 of the developer 12, a voltage value of the bias voltage supply, optimization of a thickness of the developing agent layer and fatigue of the developing agent can be estimated by detecting the current flowing in the cap 5 from the bias voltage supply 13 by the current detection circuit 38. Further, when the drum is stopped so that the cap 5 is opposed to the charger 16 and the current flowing in the cap 5 from the charger 16 is detected by the current detection circuit 38, dirt of the wire of the charger and influence to the discharge can be estimated.

There is known a method of utilizing the developing agent (toner) withdrawn by the cleaner 28 again to attain low cost. In FIG. 19, a feedback system 39 serves to recycle the developing agent from the cleaner 28 to the developer 12. The recycled developing agent contains paper powder 40 mixed with toner. When an amount of paper powder is small, there is no problem, while as the amount of paper powder is increased, deterioration of the printing quality is remarkable. In this case, a phenomenon that a resistance of the developing agent layer is reduced as the amount of paper powder is increased is utilized to detect the current flowing in the cap 5 from the developing roll 10, so that the relative amount of paper powder contained in the developing agent in the developer can be estimated. Detection of the amount of paper powder contained in the developing agent in the developer can be performed by newly providing a separate current detection circuit 41 and detecting a current flowing in the current detection circuit 41 from the bias voltage supply 13 to thereby estimate the amount of paper powder. The current value detected at this time is supplied to the controller 14.

As described above, by using the cap 5 of the drum 4 as the current detection electrode, the life of the transfer belt, the life of the developing agent, the amount of paper powder contained in the developing agent and contamination state of the charger wire can be estimated.

Figure 20:
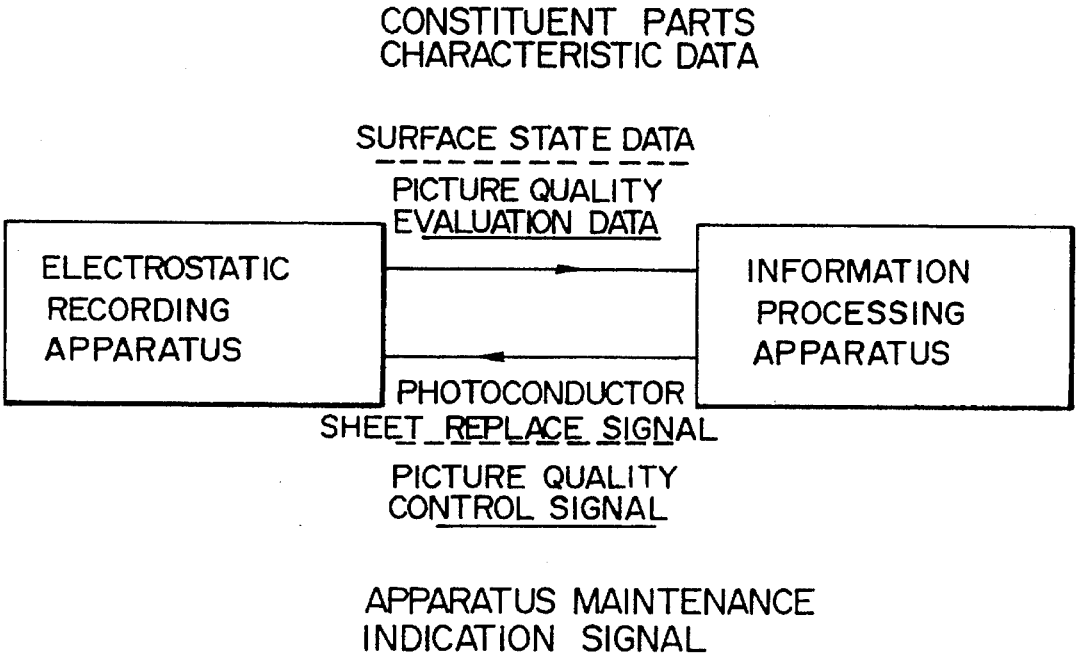
FIG. 20 is a system configuration diagram showing a managing system including an information processing system and an electrostatic recording apparatus, to which the present invention is applied.

FIG. 20 is a diagram for explaining a managing system in which an information processing apparatus located separately with respect to the recording apparatus. In the embodiments described above, the operations such as the controls of the developer bias voltage and of the charger are carried out by arithmetic processing section in the electrostatic recording apparatus; however, in cases where processing such as a full color printing is achieved with a super high picture quality in association with a super high speed and super precision computer graphics, the controls are required to be effected with a higher precision. In such a case, the information processing apparatus is to control the electrostatic recording apparatus. There can be considered two methods (1) and (2) for this system as follows.

(1) Evaluation of life of photoconductor sheet and replacement of photoconductor drum Data indicating the surface state of the photoconductor sheet is sent from the electrostatic recording apparatus to the information processing apparatus to be processed therein, so that when the end of life is found as a result of the data processing, a photoconductor sheet replace signal is supplied from the information processing apparatus to the electrostatic recording apparatus, thereby replacing the photoconductor sheet in an automatic manner or manually.

(2) Picture quality control

An image printed out by the electrostatic recording apparatus is read by a read mechanism so as to form data therefrom such that the data is sent to the information processing apparatus, which in turn effects a data processing thereon and then transmits picture quality control signals indicating the charged amount, the exposure amount, and the development condition to the electrostatic recording apparatus, thereby achieving the picture quality control.

In addition, it is also effective that the information processing apparatus is used to accomplish a failure diagnosis and a defect preventive operation on the electrostatic recording apparatus. That is, the electrostatic recording apparatus supplies the information processing apparatus with characteristic data of the constituent parts such as the wire of the charger, the exposure power, the developer, the heat roll, and the erase lamp such that the data is compared with the life judge data related to the respective constituent parts so as to generate an apparatus inspection indication signal. With this provision, it is possible to beforehand prevent a failure from occurring in the electrostatic recording apparatus.

Figure 21:
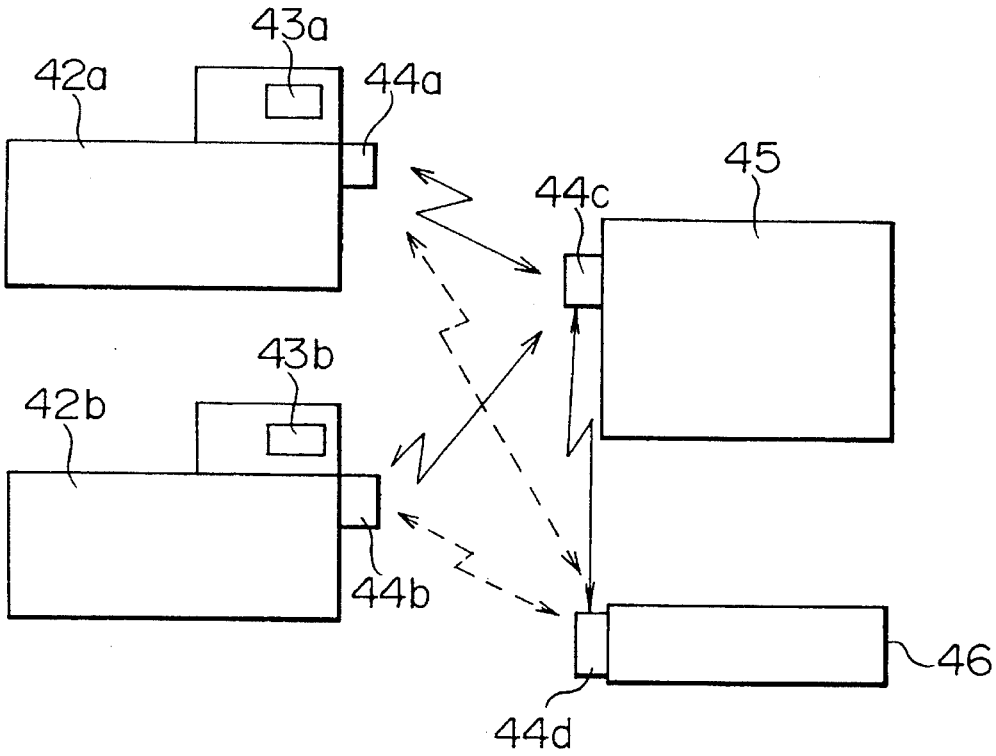
FIG. 21 is a diagram showing a diagnosis system for an electrostatic recording apparatus.

FIG. 21 schematically illustrates an online diagnosis system of the electrostatic recording apparatus. In FIG. 21, numerals 42*a* and 42*b* denote electrostatic recording apparatuses, 45 a central information processing unit installed in a control center for diagnosing the plurality of electrostatic recording apparatuses remotely, 46 a processing unit of a service center, 43*a* and 43*b* display units provided in the respective electrostatic recording apparatuses, and 44*a*, 44*b*, 44*c* and 44*d* transmitting and receiving or transceiver units. In FIG. 21, the central information processing unit 45 includes a computer and collects information such as states of mechanisms, the number of printed sheets of pager and a remaining amount of developing agent to process the information. Such information of the electrostatic recording apparatuses 42*a* and 42*b* may be displayed in the display units 43*a* and 43*b* by their controllers 14 or may be transmitted to the central information processing apparatus 45 through the transceiver units 44*a*, 44*b* and 44*c* and a communication medium (communication line). A diagnosis system of the electrostatic recording apparatus is described in U.S. Pat. No. 5,404,201. The disclosure of this application is incorporated herein by reference.

Information such as a jam of paper and a failure capable of being treated there is directly displayed on the display units 43*a* and 43*b*. A public communication line or a private communication line provided in a company can be used as the communication line.

Information relative to the states of mechanisms of the electrostatic recording apparatuses 42*a* and 42*b* involves a value of current flowing into the drum cap 5 from the belt for estimating the remaining life of the transfer belt 29, a value of current flowing into the drum cap 5 from the developer roll 10 for estimating the life of the developing agent and an amount of paper powder contained in the developing agent and a value of current flowing into the drum cap 5 from the charger 16. Further, information relative to the state of mechanism involves the surface potential of the photoconductor and variation of light intensity of the exposure system. The information is sent to the central information processing unit 45 through the transceiver units and the communication medium.

The central information processing unit 45 analyzes the information and performs statistical processing to estimate the life of the transfer belt 29, the life of the developing agent 21, the amount of paper powder contained in the developing agent, deterioration and contamination state of the wire of the charger, the life of the photoconductor 2 and the life of the exposure system such as LD and LED and diagnose troubles. The results thereof can be sent through the transceiver units 44*a*, 44*b*, 44*c* and 44*d* to the respective electrostatic recording apparatuses and displayed on the attached display units 43*a* and 43*b*. Further, the result can be sent from the central information processing unit 45 to the processing unit 46 at the service center and can cause a service man to go to a place where the electrostatic recording apparatus is installed for exchange of the transfer belt, the developing agent, the photoconductor, the charger wire, the LD and the LED and cleaning within the developer and the charger on the basis of the sent diagnosis information. Alternatively, when the periodical inspection is made or when any trouble is found in the data sent from an electrostatic recording apparatus, various inspection instructions can be sent from the central information processing unit 45 or the information processing unit 46 at the service center to the corresponding electrostatic recording apparatus and service can be made on the basis of the result thereof, so that effective service can be provided. In this case, if an identification data is adapted to be assigned to each of the electrostatic recording apparatuses and be held in the controller, each apparatus can be inspected in response to the corresponding inspection instructions.

The method of sending the state of mechanism of an electrostatic recording apparatus to the central information processing unit is classified as follows:

(a) Information of the mechanism state is sent from the electrostatic recording apparatus periodically, for example, once a day at a predetermined time.

(b) A judgment circuit is provided in the electrostatic recording apparatus and when a previously set value is exceeded, the information of the mechanism state is sent from the electrostatic recording apparatus to the central information processing unit.

(c) Information is sent at an arbitrary time by the user's decision of the electrostatic recording apparatus.

In the methods (a), (b) and (c), the electrostatic recording apparatus is the subject and the information is sent from the electrostatic recording apparatus to the central information processing unit.

(d) A signal representative of transmission of data is sent from the central information processing apparatus to the electrostatic recording apparatus upon the periodical inspection or the like and the electrostatic recording apparatus sends the information of the mechanism state to the central information processing unit in response to the signal.

Further, the central information processing unit may start the above operation in response to instructions from the service center.

The central information processing unit monitors the information sent thereto from the electrostatic recording apparatus and when the central information processing unit judges that more detailed information is required, the central information processing unit issues instructions to the electrostatic recording apparatus to send the information of the mechanism state including associated data so that the information is sent from the electrostatic recording apparatus to the central information processing unit.

Figure 23:
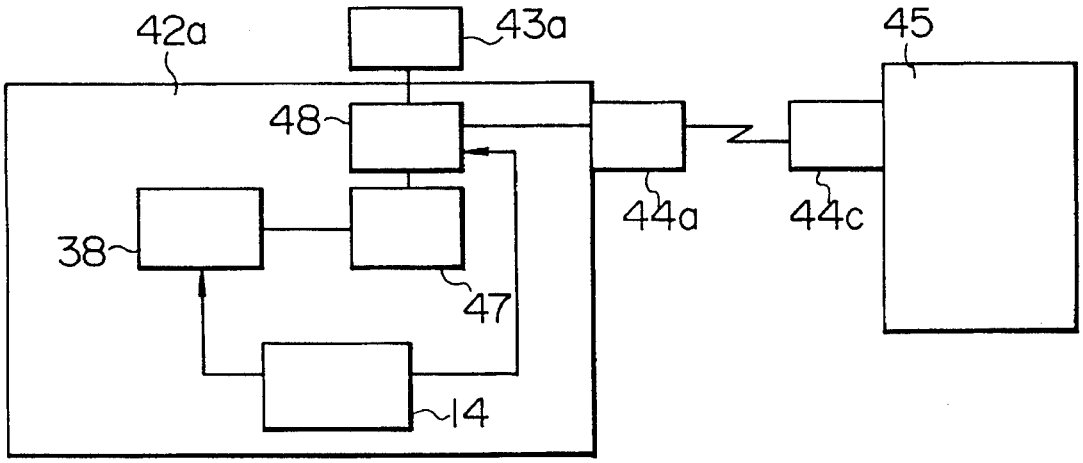
FIG. 23 is a block diagram showing a system configuration required to obtain the data of the mechanism state of the electrostatic recording apparatus and transmit the data to the central information processing unit.

FIG. 23 is a block diagram schematically illustrating a system configuration required to obtain the information of the mechanism state of the electrostatic recording apparatus and transmit the information to the central information processing unit. The electrostatic recording apparatus 42*a* shown in FIG. 11 is used as its representative. A current detection circuit 38 starts its operation in response to an instruction of the controller 14 and measured data is stored in a data storage 47 (including an A/D converter, a memory and an operation unit). When a data judgment circuit 48 judges that any of values or ranges set previously for measured data is exceeded, the information including the measured data for an item exceeding the range is sent to the central information processing unit 45 through the transceiver unit 44*a* and the communication medium in accordance with an instruction of the controller 14.

Further, the information can be displayed on the display unit 43*a*, so that the contents of the information sent to the central information processing unit 45 can be confirmed.

According to the present invention, the following effects are obtained.

(1) Since the reference potential measure section keeping a predetermined potential is formed in a portion of the area on the surface of the photoconductor drum, the surface potential of the charge receiving surface (photoconductor sheet) can be controlled through a potential comparison between the reference potential measure section and the charge receiving surface. In consequence, the calibration need not be continually accomplished on the surface potential detect means; furthermore, the surface potential can be simply controlled with quite a high precision.

(2) Since a local variation of the potential on the photconductor sheet after the charge operation can be measured with a high precision, it is possible to evaluate the life of the photoconductor sheet in association with the deterioration of the surface thereof and hence to determine the timing of the replacement of the photoconductor sheet.

(3) The potential of the reference potential measure section can be appropriately set; in consequence, it is possible, when this portion passes the developer, to easily prevent the toner from attaching thereonto, namely, to prevent the toner from being transcribed onto an area where the toner is not required.

(4) On the photoconductor drum, there is disposed the reference potential measured section having a predetermined potential, and hence the surface potential detect means can be easily calibrated without necessitating an operation to move the surface potential detect means from the photoconductor drum.

In addition, the following effects are developed by adopting the method of evaluating the life of the photoconductor sheet according to the present invention.

(5) Since the reference potential measured section having a predetermined potential is formed in a portion of the photoconductor sheet, it is possible, without necessitating an operation to recognize the absolute value of the surface potential of the charge receiving surface (the photoconductor surface as an evaluation object), to evaluate the life depending on the compared value related to the reference potential measured section. In consequence, without necessitating the calibration of the surface potential detect means, the surface potential can be controlled with a high precision.

(6) The variation in the charged potential of the photoconductor sheet, the residual potential thereof, and the surface current thereof can be measured with a high accuracy; and hence, based on the results of the measurements, the life of the photoconductor sheet can be easily evaluated with a high precision.

(7) On the photoconductor drum, there is disposed the reference potential measured section having a predetermined potential, and hence the surface potential detect means can be easily calibrated without necessitating an operation to move the surface potential detect means from the photoconductor drum.

(8) The electrostatic recording apparatus according to the present invention is suitable in a case where an information processing system including a combination of the recording apparatus and an information processing apparatus is to be configured. In consequence, it is possible to accomplish the life evaluation of the photoconductor sheet, the picture quality control, and the failure diagnosis of the electrostatic recording apparatus.

While particular embodiments of the invention have been shown and described, it will be obvious to those skilled in the art that various changes and modifications may be made without departing from the present invention in its broader aspects.

(9) Since the capacitor connected to the cap is charged by the charger and the developing agent layer and the cap are separated from each other mechanically or electrically until the potential of the cap reaches the predetermined potential, the cap surface is not developed even if the potential at the cap is low. That is, toner is not attached.

(10) When the photoconductor drum is suddenly stopped due to a jam of paper or a trouble of a printer, electric charge stored in the capacitor connected to the cap is removed. Accordingly, when an operator removes sheets of paper wound on the drum or examines the drum, the operator is not struck by electricity even if the operator comes into contact with the cap.

(11) Since the photoconductive drum is stopped so that the cap is opposed to the charger, the capacitor connected to the cap can be rapidly charged by the charger when the apparatus is restarted after recovery of the trouble. Accordingly, the restarting (restoration) time can be made short.

(12) When the belt transfer system is used as the transfer system, the belt can not be flawed by avoiding the cap edge from being pressed on the transfer belt during rotation of the drum.

(13) Since the cap is positioned inside of ends of the drum,. the roller for securing the developing gap can be moved on the drum ends and influence of the step between the cap and the drum can be avoided.

(14) Since the cap of the drum can be used as the current measuring electrode and the current flowing in the cap from the transfer belt, the current flowing from the developer roller through the developing agent into the cap and the current flowing from the charger into the cap can be measured, the performance and the life of the transfer belt, the developing agent and the charger can be estimated without provision of a new electrode.

What is claimed is:

1. An electrostatic recording apparatus comprising:

a photoconductor drum including a cap provided in an opening of said drum and a photoconductor sheet wound on a portion of said drum except said opening, said photoconductor drum being rotated;

electrifying means for electrifying said cap;

a capacitor provided between said cap and a terminal and charged through said cap by said electrifying means to maintain said cap to an electrified state, a potential of said terminal being equal to a ground potential or a potential approximate to the ground potential; and control means for discharging the electrified electric charge of said cap in response to a discharge instruction.

2. An electrostatic recording apparatus according to claim 1, wherein said control means comprises:

connection means for connecting said cap or a connection node of said cap and said capacitor to said terminal in response to an inputted discharge instruction; and cap potential control means for supplying the discharge instruction to said connection means in response to a potential control instruction.

3. An electrostatic recording apparatus according to claim 1, further comprising a display unit, and wherein said control means further comprises means for displaying data representative of a completion of the discharge on said display unit.

4. An electrostatic recording apparatus according to claim 1, wherein said control means further comprises means for transmitting data representative of a completion of the discharge to an external apparatus upon the completion of the discharge.

5. An electrostatic recording apparatus, according to claim 1, further comprising rotation means for rotating said photoconductor drum and wherein said control means further comprises rotation control means for controlling said rotation means in response to an inputted rotation stop instruction to stop the rotation of said photoconductor drum such that said cap is positioned under said electrifying means.

6. An electrostatic recording apparatus according to claim 1, further comprising rotation means for rotation of said photoconductor drum, said control means further comprising:

means responsive to an inputted printing start instruction for controlling said electrifying means to charge said cap and controlling said rotation means to start the rotation of said photoconductor drum after said cap has been charged.

7. An electrostatic recording apparatus managing system comprising:

a communication medium;

an electrostatic recording apparatus including transmitting means for transmitting data representative of a state of said electrostatic recording apparatus through said communication medium; and managing means for judging the state of said electrostatic recording apparatus from the state data received through said communication medium to manage said electrostatic recording apparatus, wherein said electrostatic recording apparatus comprises:

a plurality of constituent elements;

at least one current detection means provided for said plurality of constituent elements, for detecting a value of current flowing therein; and said transmitting means for transmitting the detected current value as the state data through said communication medium to said managing means.

8. An electrostatic recording apparatus managing system according to claim 7, wherein said managing means further comprises instruction means for instructing said electrostatic recording apparatus to transmit the current value associated with a specific one of said plurality of constituent elements as the state data to said managing means.

9. An electrostatic recording apparatus managing system according to claim 7, wherein said managing means further comprises means for comparing the received state data with a predetermined data to inform a service center of an abnormal state when it is judged that a comparison result is abnormal.

10. An electrostatic recording apparatus managing system according to claim 7, wherein the state data includes at least one of states of a charger, a transfer belt and developing agent, an amount of paper powder contained in the developing agent, and states of a photoconductor sheet and an exposure system.

11. An electrostatic recording apparatus managing system according to claim 7, wherein said electrostatic recording apparatus includes a cap provided in an opening of a photoconductor drum, said photoconductor drum includes a photoconductor sheet wound on a portion except said opening, and said current detection means is connected to said cap to use said cap as a probe.

12. An inspection apparatus managing system comprising:

a communication medium;

an inspection apparatus comprising:

a plurality of constituent elements;

a movable detector provided for said plurality of constituent elements; and transmitting means for transmitting a detection result by said detector as a state data through said communication medium; and managing means for managing said inspection apparatus on the basis of state data received through said communication medium.

13. An electrostatic recording system, comprising:

a communication path;

an electrostatic recording apparatus for transferring a toner image formed on a charge receiving surface of a photoconductor to a transfer sheet by a transfer belt, said electrostatic recording apparatus comprising a photoconductor drum which includes a cap provided in an opening of said drum and a photoconductor sheet wound on a portion of said drum except said opening, a charger, measuring means connected to said cap, for measuring a current flowing from the charger through the transfer belt when said cap opposes to the charger and transmitting means for transmitting the measuring result through said communication path; and information processing apparatus for managing said electrostatic recording apparatus and for receiving the measuring result through said communication path from said electrostatic recording apparatus and diagnosing a lifetime of the transfer belt based on the received measuring result.

14. An electrostatic recording system according to claim 13, wherein said information processing apparatus further comprises means for transmitting the diagnosis result and countermeasure therefor to said electrostatic recording apparatus through said communication path, and said electrostatic recording apparatus further comprises a display unit and means for receiving the diagnosis result and countermeasure therefor through said communication path and displaying the same on said display unit.

15. An electrostatic recording system according to claim 13, wherein said electrostatic recording apparatus further comprises:

data storage means for storing current data measured by said measuring means; and determining means for determining whether the measured current data exceeds a previously set value;

wherein said transmitting means transmits information including the measured current data, in response to a determination by said determining means indicating that the measured current data has exceeded said previously set value.

16. An electrostatic recording system, comprising:

a communication path;

an electrostatic recording apparatus comprising a photoconductor drum which includes a cap provided in an opening of said drum and a photoconductor sheet wound on a portion of said drum except said opening, a developer roll, measuring means connected to said cap, for measuring a current flowing from the developer roll to said cap through a developing agent layer when said cap opposes to the developer roll and transmitting means for transmitting the measuring result through communication path; and information processing apparatus for managing said electrostatic recording apparatus and for receiving the measuring result through said communication path from said electrostatic recording apparatus and evaluating a lifetime of the developing agent and an amount of paper powder contained in the developing agent based on the received measuring result.

17. An electrostatic recording system according to claim 16, wherein said information processing apparatus further comprises means for transmitting the evaluating result and countermeasure therefor to said electrostatic recording apparatus through said communication path, and said electrostatic recording apparatus further comprises a display unit and means for receiving the evaluating result and countermeasure therefor through said communication path and displaying the same on said display unit.

18. An electrostatic recording system according to claim 16, wherein said electrostatic recording apparatus further comprises:

data storage means for storing current data measured by said measuring means; and determining means for determining whether the measured current data exceeds a previously set value;

wherein said transmitting means transmits information including the measured current data, in response to a determination by said determining means indicating that the measured current data has exceeded said previously set value.

19. A managing system for an electrostatic recording apparatus, comprising:

an electrostatic recording apparatus including at least one component, and means for generating state data indicative of a state of the at least one component and for transmitting the state data; and an information processing apparatus located separately and remotely from the electrostatic recording apparatus and including means for receiving the state data from the electrostatic recording apparatus, means for comparing the received state data with predetermined data for the at least one component, and managing means responsive to the comparing means for managing the electrostatic recording apparatus, wherein the electrostatic recording apparatus further includes means for reading a recorded image to produce image evaluation data and for transmitting the image evaluation data, and the image information processing apparatus further includes means for receiving the image evaluation data from the electrostatic recording apparatus, transmitting a signal for controlling image quality to the electrostatic recording apparatus based on the received image evaluation data.

20. An electrostatic recording apparatus comprising:

a plurality of constituent elements;

at least one current detecting means provided for said plurality of constituent elements, for detecting a value of current flowing therein; and transmitting means for transmitting the detected current value as a state data.

21. The electrostatic recording apparatus according to claim 20, wherein the state data includes at least one of states of a charger, a transfer belt, developing agent, and an amount of paper powder contained in the developing agent and at least one of states of a photoconductor sheet and an exposure system.

22. An electrostatic recording system according to claim 20, further comprises:

data storage means for storing detected current value data; and determining means for determining whether the detected current value data exceeds a previously set value;

wherein said transmitting means transmits information including the detected current value data, in response to a determination by said determining means indicating that the detected current value data has exceeded said previously set value.

23. An electrostatic recording apparatus for transferring a toner image formed on a charge receiving surface of a photoconductor to a transfer sheet of paper by a transfer belt, comprising:

a photoconductor drum which includes a drum, a cap provided in an opening of said drum, and a photoconductor sheet wound on a portion of said drum except said opening;

a charger; and measuring means connected to said cap, for measuring a current flowing from the charger through the transfer belt when said cap opposes to the charger and transmitting the measured result.

24. An electrostatic recording apparatus according to claim 23, further comprising means for diagnosing a lifetime of the transfer belt based on the measured result.

25. An electrostatic recording apparatus according to claim 24, wherein said diagnosing means further comprises means for determining some types of countermeasure based on the diagnosing result, and said electrostatic recording apparatus further comprises display means for display the diagnosing result and the determined types of countermeasure.

26. An electrostatic recording apparatus comprising:

at least one component;

means for generating state data indicative of a state of the at least one component and for transmitting the state data;

means for recording a recorded image; and means for producing image evaluation data based on the recorded image and for transmitting the image evaluation data.

* * * * *